US011910918B2

(12) United States Patent
Walker et al.

(10) Patent No.: US 11,910,918 B2
(45) Date of Patent: Feb. 27, 2024

(54) PRODUCT DIVIDER ASSEMBLY

(71) Applicant: Fasteners for Retail, Inc., Twinsburg, OH (US)

(72) Inventors: William H Walker, Fairlawn, OH (US); Michael Eric Liedtke, Kent, OH (US); Shane Obitts, North Ridgeville, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 17/663,178

(22) Filed: May 12, 2022

(65) Prior Publication Data

US 2022/0265041 A1 Aug. 25, 2022

Related U.S. Application Data

(63) Continuation-in-part of application No. 17/074,706, filed on Oct. 20, 2020, now abandoned.

(60) Provisional application No. 63/036,737, filed on Jun. 9, 2020, provisional application No. 62/933,812, filed on Nov. 11, 2019.

(51) Int. Cl.
*A47B 57/58* (2006.01)

(52) U.S. Cl.
CPC ..... *A47B 57/585* (2013.01)

(58) Field of Classification Search
CPC ..... A47B 57/585; A47B 57/58; A47B 65/15; A47F 5/005; A47F 1/125; A47F 1/126; A47F 5/132; A47F 7/144; A47F 1/12
See application file for complete search history.

(56) References Cited

U.S. PATENT DOCUMENTS 3,077,977 A * 2/1963 Wood ..... B44D 3/04 211/70.6
3,837,477 A * 9/1974 Boudreau ..... B65D 5/50 211/70.6
4,641,406 A * 2/1987 Rogers ..... B23P 15/14 29/893.3
4,944,196 A * 7/1990 Rivin ..... F16H 55/17 74/462
D312,017 S * 11/1990 Gould ..... D6/552
(Continued)

FOREIGN PATENT DOCUMENTS

EP 1106116 A1 6/2001
WO 2020202083 A1 10/2020

OTHER PUBLICATIONS

European Search Report for Application EP20203284.3 dated Mar. 25, 2021.

(Continued)

*Primary Examiner* — Devin K Barnett
(74) *Attorney, Agent, or Firm* — Honigman LLP

(57) ABSTRACT

A retail management system includes a carriage base and an engagement mechanism. The carriage base includes a first end defining a front surface and a second end formed at an opposite end from the first end. The engagement mechanism is disposed at the first end of the carriage base and includes a plurality of carriage teeth extending from the front surface, the plurality of carriage teeth including at least one primary carriage tooth having a first configuration and at least one secondary carriage tooth having a second configuration that is different than the first configuration.

17 Claims, 18 Drawing Sheets

(56) References Cited

U.S. PATENT DOCUMENTS 5,190,186 A * 3/1993 Yablans ..... G07F 11/60 221/124
5,346,063 A * 9/1994 Chow ..... B25H 3/04 206/483
5,505,316 A * 4/1996 Lee ..... B25H 3/04 211/175
D392,489 S * 3/1998 Ernst ..... D6/571
6,039,178 A * 3/2000 Ernst ..... B25H 3/06 211/70.6
6,142,316 A * 11/2000 Harbour ..... A47F 1/12 211/74
6,332,547 B1 * 12/2001 Shaw ..... A47F 1/12 211/59.2
6,715,621 B2 * 4/2004 Boron ..... A47F 1/12 211/74
7,104,410 B2 * 9/2006 Primiano ..... A47F 1/12 211/183
7,424,957 B1 9/2008 Luberto
7,841,479 B2 * 11/2010 Budge ..... A47F 1/087 211/59.2
8,162,154 B2 * 4/2012 Trulaske, Sr. ..... A47F 1/12 211/183
8,177,076 B2 5/2012 Rataiczak, III et al.
8,863,963 B2 * 10/2014 Hardy ..... A47F 5/005 211/74
9,532,662 B2 * 1/2017 Desmond ..... G09F 3/204
9,782,017 B1 * 10/2017 Luberto ..... A47F 1/125
10,172,481 B2 1/2019 Walker et al.
10,392,046 B2 * 8/2019 Mizushima ..... B21K 1/767
10,638,856 B2 * 5/2020 Nagel ..... A47F 5/005
D919,340 S * 5/2021 Obitts ..... D6/678
11,033,771 B2 * 6/2021 Juen ..... A63B 71/0036
2001/0002659 A1 * 6/2001 Bada ..... A47F 1/126 211/184
2002/0170866 A1 * 11/2002 Johnson ..... A47F 1/126 211/59.3
2003/0029765 A1 * 2/2003 Bhatt ..... B29C 45/14311 211/41.18
2003/0168420 A1 * 9/2003 Primiano ..... A47F 1/12 211/74
2005/0077260 A1 * 4/2005 Mueller ..... A47F 1/126 211/59.3
2005/0092703 A1 * 5/2005 Mueller ..... A47F 1/126 211/59.3
2007/0187344 A1 * 8/2007 Mueller ..... A47F 1/126 211/59.3
2007/0256992 A1 * 11/2007 Olson ..... A47F 5/005 211/59.3
2008/0017598 A1 * 1/2008 Rataiczak ..... A47F 1/126 211/59.3
2008/0143128 A1 * 6/2008 Kuhns ..... B08B 1/008 294/51
2010/0089847 A1 * 4/2010 Rataiczak, III ..... A47F 1/126 211/59.3
2010/0258513 A1 * 10/2010 Meyer ..... A47F 1/126 211/59.3
2011/0174750 A1 * 7/2011 Poulokefalos ..... A47F 1/126 211/59.3
2012/0006773 A1 * 1/2012 Mueller ..... A47F 1/126 211/59.3
2013/0062295 A1 * 3/2013 Bird ..... A47F 1/126 211/59.3
2013/0153123 A1 * 6/2013 Pasch ..... B29C 43/46 156/138
2014/0263133 A1 * 9/2014 Walker ..... A47F 5/005 24/561
2014/0263134 A1 * 9/2014 Walker ..... A47B 57/58 211/184
2015/0374120 A1 * 12/2015 Hardy ..... A47F 7/0007 211/59.4
2016/0029794 A1 * 2/2016 Obitts ..... A47F 5/005 403/376
2016/0088935 A1 * 3/2016 Brej ..... A47F 5/005 211/126.6
2016/0296038 A1 * 10/2016 Walker ..... A47F 1/125
2016/0296039 A1 * 10/2016 Bird ..... A47B 57/58
2017/0035218 A1 * 2/2017 Riley ..... A47F 1/126
2017/0119175 A1 * 5/2017 Hardy ..... A47B 87/0223
2017/0196355 A1 * 7/2017 Hardy ..... A47B 57/588
2017/0202369 A1 * 7/2017 Mercier ..... A47F 5/083
2018/0000262 A1 * 1/2018 Pritchard ..... A47F 1/126
2018/0153313 A1 * 6/2018 Padvoiskis ..... A47F 5/005
2018/0213947 A1 * 8/2018 Bird ..... A47B 57/58
2018/0242756 A1 8/2018 Berg et al.
2020/0054151 A1 * 2/2020 Hardy ..... A47F 5/0025
2020/0093283 A1 * 3/2020 Hardy ..... A47F 5/0025
2020/0170420 A1 * 6/2020 Bird ..... A47F 7/28
2020/0315371 A1 * 10/2020 Ewing ..... G07F 11/22
2021/0037991 A1 * 2/2021 Ewing ..... A47F 1/126
2021/0052087 A1 * 2/2021 Nagel ..... A47F 1/126
2021/0059434 A1 * 3/2021 Ciesick ..... A47F 5/0043
2021/0137265 A1 * 5/2021 Liedtke ..... A47F 5/005

OTHER PUBLICATIONS

USPTO, Office Action relating to U.S. Appl. No. 17/074,706, dated Feb. 2, 2022.

* cited by examiner

PRODUCT DIVIDER ASSEMBLY

CROSS REFERENCE TO RELATED APPLICATIONS

This application claims priority under 35 U.S.C. § 120 from, U.S. patent application Ser. No. 17/074,706 filed on Oct. 20, 2020, which claims priority under 35 U.S.C. § 119(e) to U.S. Provisional Application 62/933,812, filed on Nov. 11, 2019, and U.S. Provisional Application 63/036,737, filed on Jun. 9, 2020. The disclosures of these prior applications are considered part of the disclosure of this application and are hereby incorporated by reference in their entireties.

FIELD

The present disclosure relates generally to product shelf displays, and more particularly to a product shelf display including a translatable divider and/or pusher.

BACKGROUND

This section provides background information related to the present disclosure and is not necessarily prior art.

Products in a commercial setting, such as a store, may be displayed in a variety of ways. For example, a series of shelving units may be used to stock and display the products. The products may be arranged in columns and rows, with products of the same type arranged in a column behind one another and products of different types arranged in a row next to each other. When the first product in a column is selected and removed from the shelf, the second product in the column may be moved to the first product's position to occupy the void left by the removal of the first product. Products in adjacent columns may have different sizes (e.g., widths). Moveable dividers and pushers may be used to ensure that products in arranged in rows and columns are maintained in close proximity to one another when the first product in a column is removed and when products of different types are placed and arranged in rows next to each other.

SUMMARY

This section provides a general summary of the disclosure, and is not a comprehensive disclosure of its full scope or all of its features.

An aspect of the disclosure provides an example of a retail management system including a carriage base and an engagement mechanism. The carriage base includes a first end defining a front surface and a second end formed at an opposite end from the first end. The engagement mechanism is disposed at the first end of the carriage base and includes a plurality of carriage teeth extending from the front surface, the plurality of carriage teeth including at least one primary carriage tooth having a first configuration and at least one secondary carriage tooth having a second configuration that is different than the first configuration.

This aspect of the disclosure may include one or more of the following optional features. In some examples, the first size is a first length measured from the front surface to a distal end of the primary carriage tooth and the second size is a second length measured from the front surface to a distal end of the secondary carriage tooth. In some configurations, each of the carriage teeth includes a top end defining a substantially planar surface perpendicular to the front surface.

In some implementations, each of the carriage teeth has a first height extending along the front surface from a bottom end to a top end and includes a lower biasing surface formed adjacent to the bottom end. In some examples, the lower biasing surface extends at an oblique angle relative to the front surface of the carriage base. In some implementations, the lower biasing surface includes an arcuate portion immediately adjacent to the bottom end. In some configurations, the lower biasing surface has a second height that is at least half of the first height. In some configurations, each of the carriage teeth includes an arcuate peripheral side surface extending between the bottom end and the top end.

In some examples, the engagement mechanism is operable between a retracted position and an extended position relative to the front surface of the carriage base. In some configurations, the engagement mechanism is integrally formed with the front surface of the carriage base.

In some implementations, the engagement mechanism is a carriage engagement mechanism, and wherein the system further includes a rail. Optionally, the rail includes a rail engagement mechanism operable to move between a first configuration and a second configuration. In some implementations, the rail includes a frame and the rail engagement mechanism is attached to the frame and operable to move a first configuration and the second configuration.

In some examples, the rail engagement mechanism includes a plurality of rail teeth configured to move relative to the frame. In some implementations, each of the plurality of the rail teeth is coupled to the frame by a resilient member including a different material than the frame. In some examples, each of the plurality of the rail teeth is integrally formed with the resilient member. In some implementations, the rail engagement mechanism includes a flexible front wall attached to the resilient member and the plurality of rail teeth extend from the front wall. In some examples, the resilient member includes a strip of a first material disposed between the frame and the rail engagement mechanism, the first material having a lower durometer than a second material forming the frame or the rail engagement mechanism.

Another aspect of the disclosure provides examples of an engagement mechanism for a retail management system including a rail. In some examples, the engagement mechanism includes a biasing element including a first end and a second end formed on an opposite side of the biasing element from the first end, and a first engagement element disposed at the first end of the biasing element that has a front surface having a plurality of teeth including at least one primary tooth having a first configuration and at least one secondary tooth having a second configuration different than the first configuration.

This aspect of the disclosure may include one or more of the following optional features. In some examples, the engagement mechanism includes a second engagement element disposed at the second end of the biasing element and defining an elongate track configured to slidably receive the rail. In some implementations, the second engagement element includes an engagement feature configured to slidably secure the engagement mechanism to the rail. In some configurations, the biasing element is configures a resilient biasing element operable between compressed configuration having a first length between the first end and the second end and a relaxed configuration having a second length between the first end and the second end that is greater than the first length. In the compressed configuration, the biasing element applies a biasing force to at least one of the first engagement element and the second engagement element.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
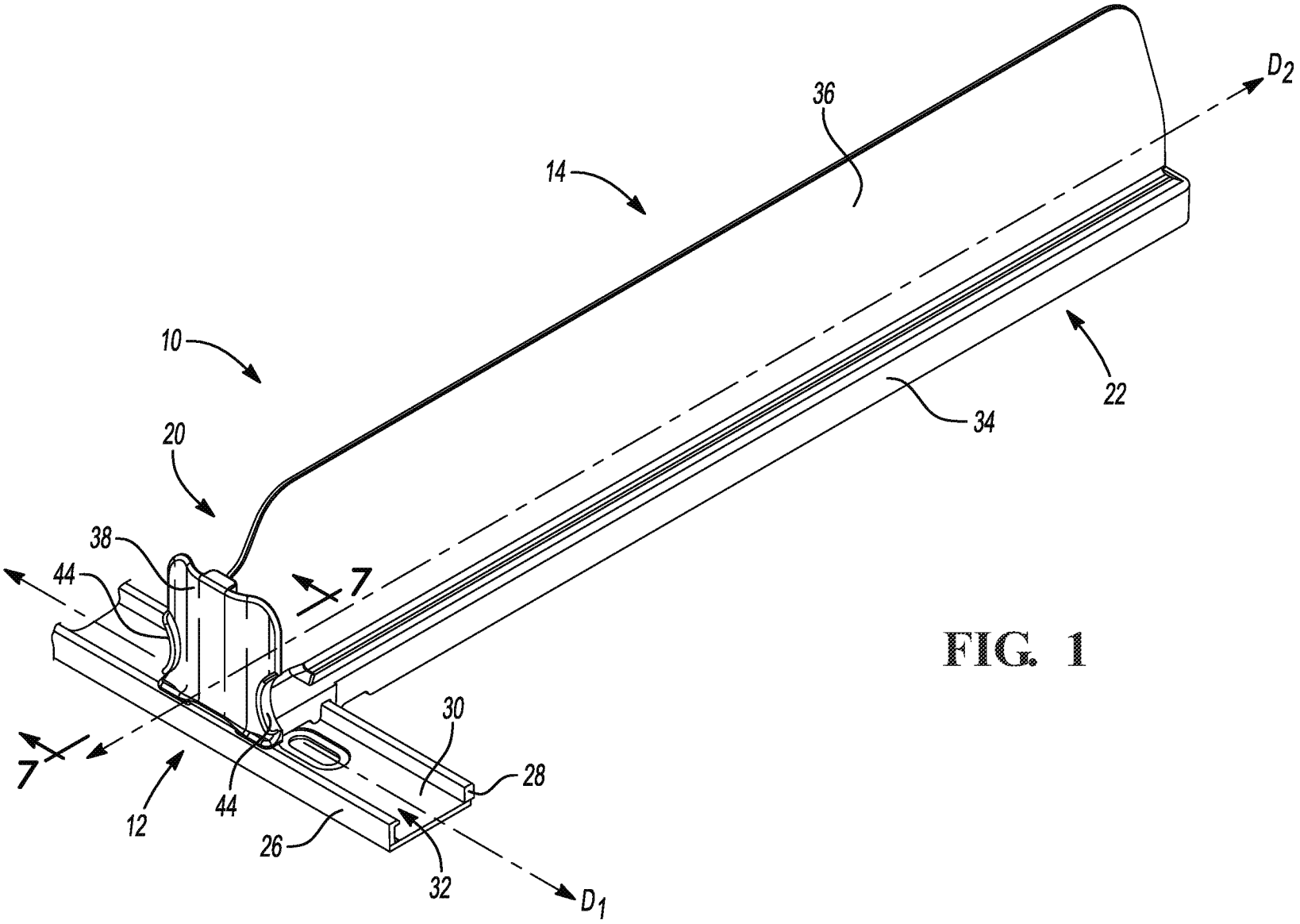
FIG. 1 is a top front perspective view of a product carriage assembly including a rail and a divider in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Referring to FIG. 1, a product management system 10 is generally shown. The product management system 10 may be disposed on a shelf (not shown) or other suitable supporting device, and may include a rail 12, a carriage assembly 14, and, in some implementations, a pusher (not shown). For the sake of describing the features of the disclosure, the product management system and components thereof may be described in terms of a first axis or direction $D_1$ that extends generally along a lateral direction corresponding to the length of the rail 12, a second axis or direction $D_2$ that extends generally perpendicular to the first direction $D_1$ and along a longitudinal direction of the carriage assembly 14, and a third axis or direction $D_3$ corresponding to a vertical direction extending perpendicular to each of the first direction $D_1$ and the second direction $D_2$.

The rail 12 extends in the first direction $D_1$. The carriage assembly 14 extends in a second direction $D_2$ perpendicular to the first direction $D_1$ and is coupled to the rail 12 for translation in the first direction $D_1$. Specifically, the rail 12 includes a rail engagement mechanism 16 and the carriage assembly 14 includes a carriage engagement mechanism 18 configured to engage with the rail engagement mechanism 16. The engagement mechanisms 16, 18 may be configured to enable the carriage assembly 14 to selectively translate along the rail 12 in the first direction $D_1$.

In some implementations, the engagement mechanisms 16, 18 may enable the carriage assembly 14 to selectively translate along the rail 12 in the first direction $D_1$ without the use of a manual engagement actuator, such as a button, switch, etc., for selectively engaging and disengaging the carriage assembly 14 with the rail 12. By eliminating the need for a manual actuator, the product management system 10 may reduce the number of components, thus, reducing weight, cost, and materials. Further, the means for translating the carriage assembly 14 along the rail 12 may be simplified compared to a manual actuator, and such a configuration eliminates the confusion as to whether the carriage assembly 14 is engaged with or disengaged from the rail 12, thus, reducing the risk of damage incurred by the product management system 10.

Figure 2:
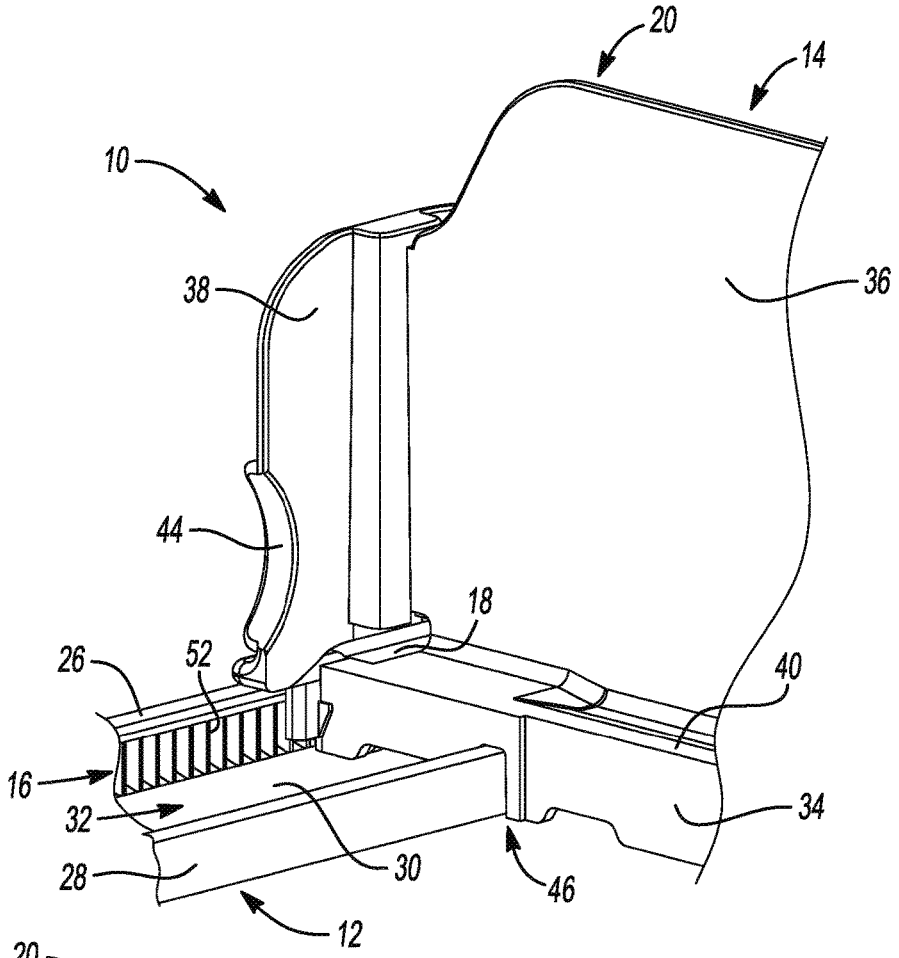
FIG. 2 is a top rear perspective view of the rail and the divider of FIG. 1.

Referring to FIGS. 1 and 2, the rail 12 may be configured to be placed on a shelf (not shown) or other suitable surface of a store or other suitable location. For example, the rail 12 may include a generally flat bottom surface. In some implementations, the rail 12 may include feet or gripping members (not shown) to reduce friction between the rail and the shelf. In other implementations, the rail 12 may be secured to the shelf in any suitable manner, such as, for example, mechanical fasteners, adhesive, welding, etc. While the product management system 10 is shown in FIG. 1 as including one rail 12 and one carriage assembly 14, it should be understood that any suitable number of these components may be implemented, including an optional pusher (not shown).

The rail 12 may have a generally U-shaped cross-section including a front wall 26, a rear wall 28, and a base 30 connecting the front wall 26 to the rear wall 28. The front wall 26, the rear wall 28, and the base 30 cooperate to define a channel 32 configured to receive a portion of the carriage assembly 14 and a portion of the pusher. The front wall 26 may include the rail engagement mechanism 16. For example, the rail engagement mechanism 16 may be attached to or integrally formed with the front wall 26. In other implementations, the rail engagement mechanism 16 may be located at any suitable location on the rail 12. In some implementations, the rail engagement mechanism 16 includes an upper flange 50 formed at a distal end of the front wall 26 and a plurality of rail teeth 52 each extending between the upper flange 50 and the base 30, whereby the rail teeth 52 arranged in series along the front wall 26 in the first direction $D_1$. In other implementations, the rail engagement mechanism 16 may be any suitable engagement mechanism, such as, for example, a mechanical fastener, a magnet, an electromagnet, a hook-and-loop fastener, a high-friction material, etc.

Referring to FIGS. 1 and 2, the carriage assembly 14 extends from the front portion 20 to the rear portion 22. As used herein, the term "front" generally refers to the portion of the carriage assembly 14 that would be facing prospective customers or an aisle in a store and the term "rear" generally refers to the portion of the carriage assembly 14 that is furthest from prospective customers or an aisle in a store. In some implementations, as shown in FIG. 1, the front portion 20 of the carriage assembly 14 may engage the rail 12, i.e., be received in the channel 32. In other implementations, the rail 12 may be disposed entirely between the front portion 20 and the rear portion 22 of the carriage assembly 14. While the rail 12 is shown as being disposed closer to the front portion 20 than the rear portion 22, in some implementations, the rail 12 may be disposed closer to the rear portion 22 than the front portion 20 or disposed equidistant from (e.g., centrally located between) the front portion 20 and the rear portion 22.

The carriage assembly 14 includes a carriage base 34, a dividing wall 36 attached to the carriage base 34, and a front stopper 38. The carriage base 34 and the dividing wall 36 generally extend from the front portion 20 to the rear portion 22, while the stopper 38 is disposed at or near the front portion 20 to cooperate with a pusher (not shown) to hold products in place. The carriage base 34 includes a top surface configured to receive and support products. In some implementations, the carriage base 34 includes a slot 46 for receiving the rear wall 28 of the rail 12.

Figure 3:
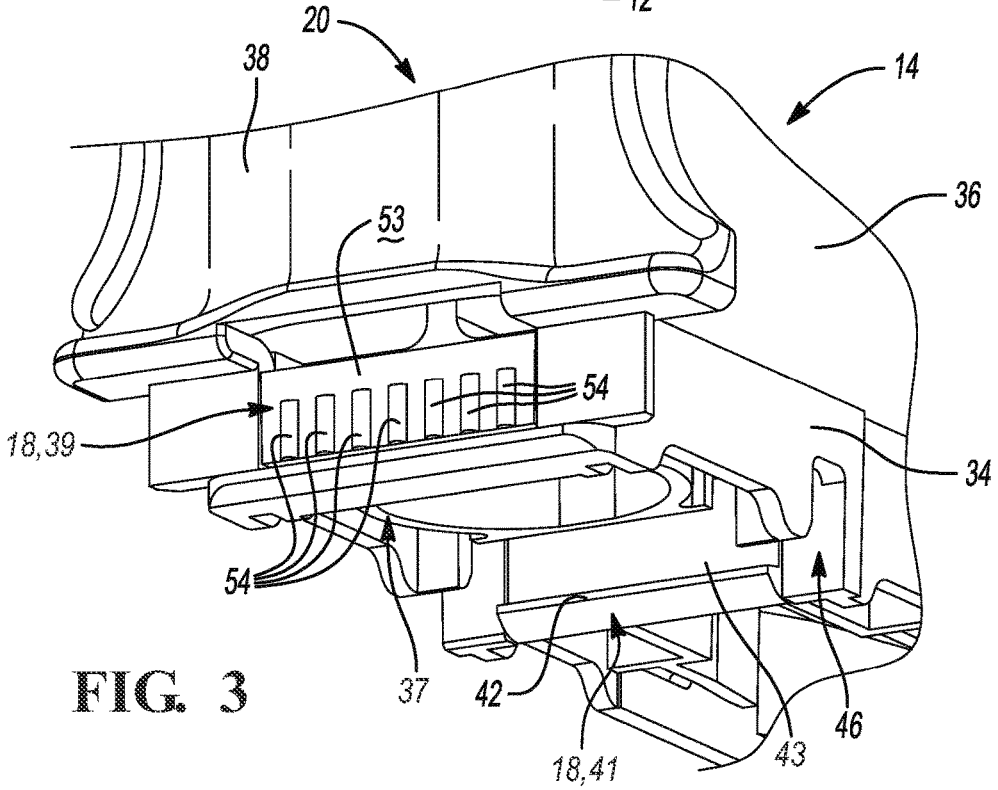
FIG. 3 is a bottom front perspective view of the divider of FIG. 1.
Figure 6:
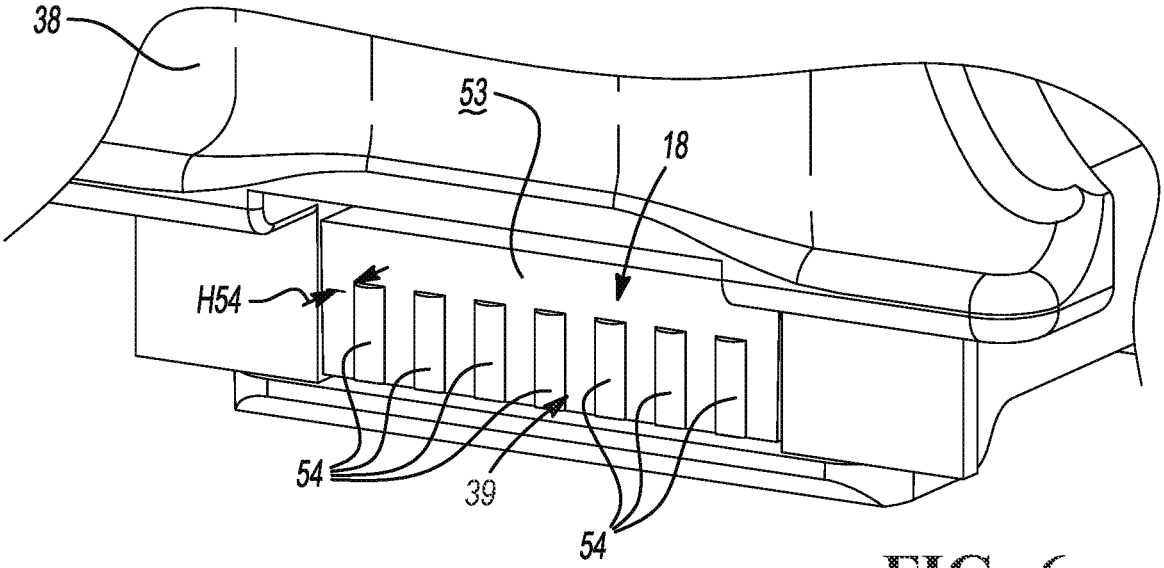
FIG. 6 is an enlarged view of a portion of the divider of FIG. 1.
Figure 7:
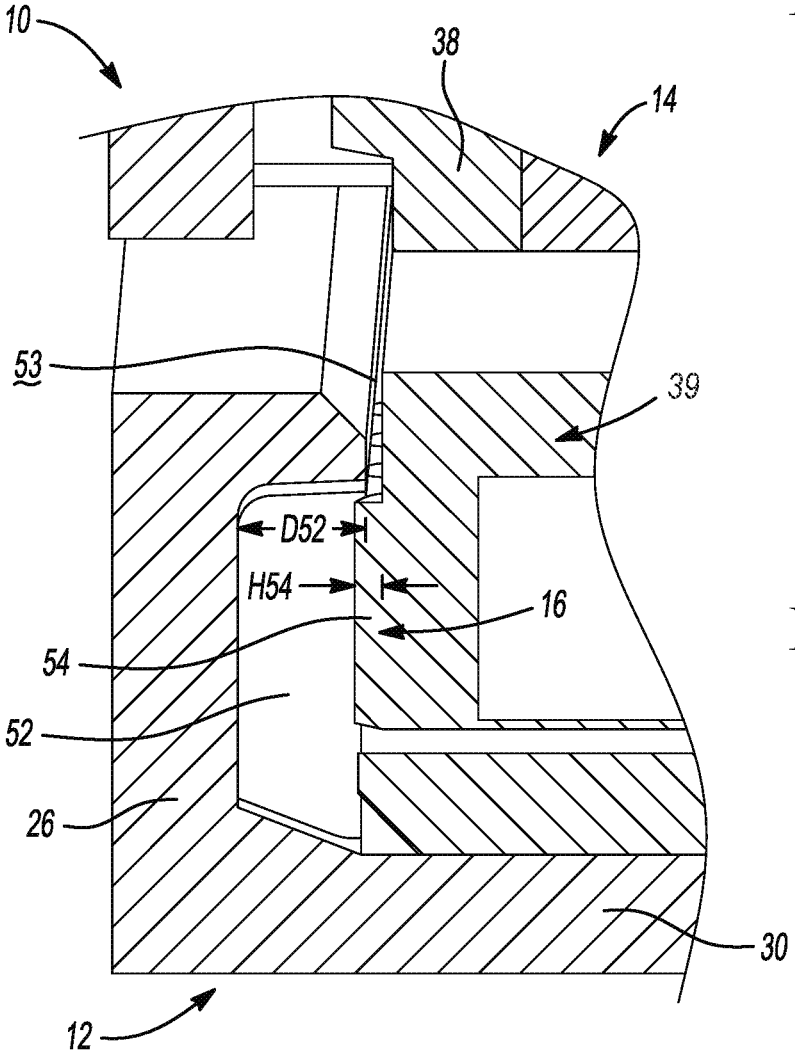
FIG. 7 is a cross-sectional view of the rail and the divider taken along line 7-7 of FIG.
Figure 8:
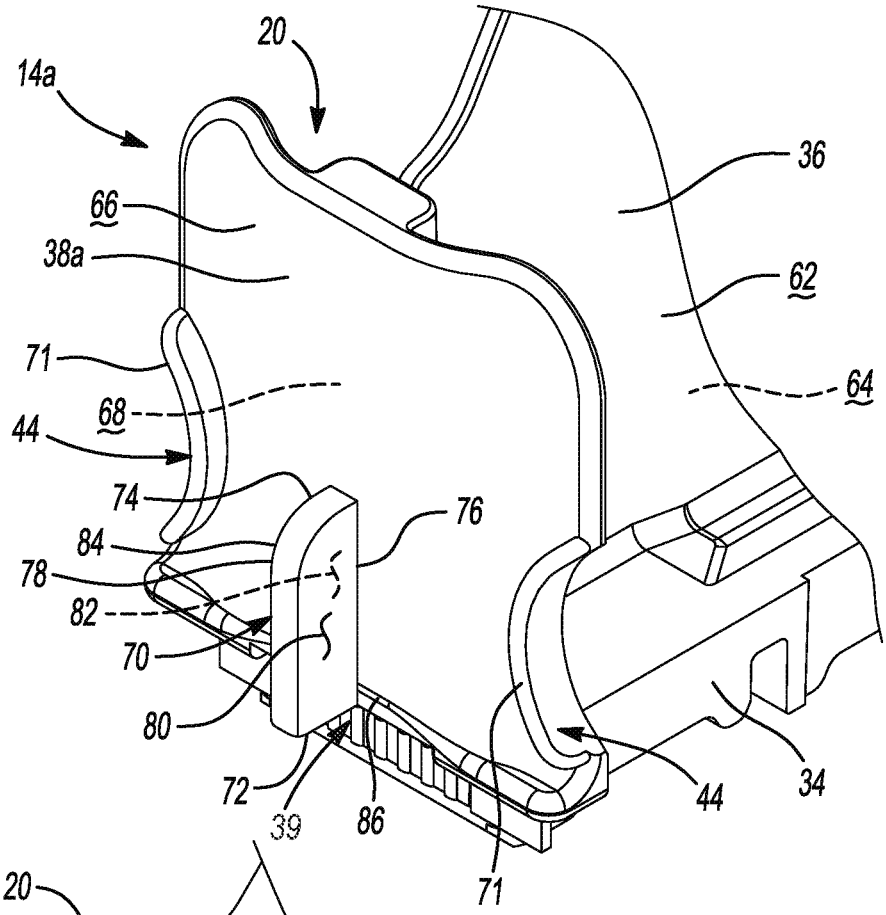
FIG. 8 is a top front perspective view of another product divider for use with the rail of FIG. 1, in accordance with the principles of the present disclosure.
Figure 9:
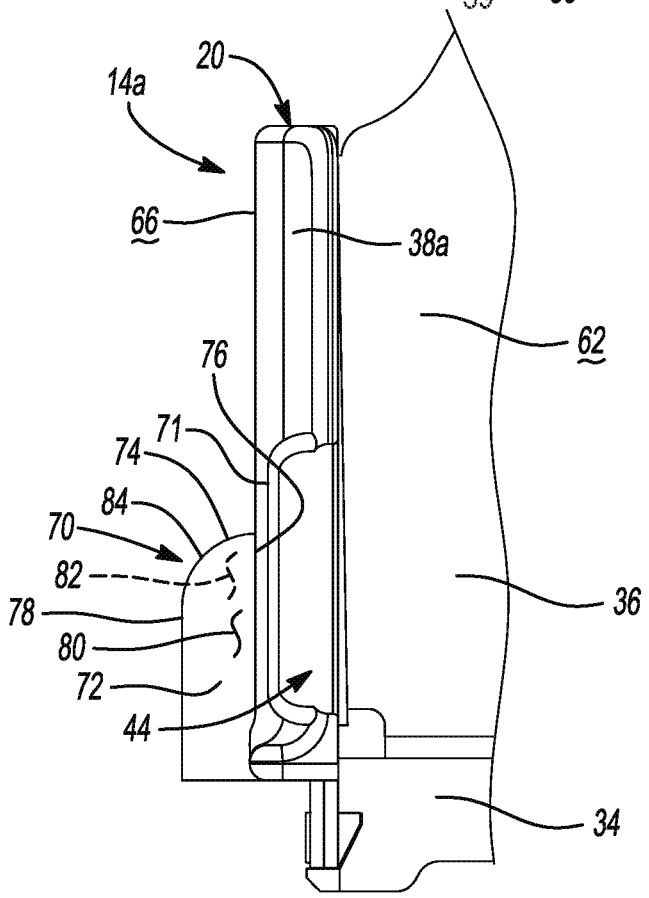
FIG. 9 is a side view of the product divider of FIG. 8.

Referring to FIGS. 3 and 6, the carriage assembly 14 may include the carriage engagement mechanism 18 at or near the front portion 20. For example, the carriage engagement mechanism 18 is disposed in a cavity 35 formed in a bottom side of the carriage base 34 at the front portion 20. In the illustrated example, the carriage engagement mechanism 18 includes a biasing element 37 disposed within the cavity 35, a front engagement element 39 attached to a first end of the biasing element 37 and disposed below the stopper 38 in the front portion 20 of the carriage assembly 14, and a rear engagement element 41 attached to an second end of the biasing element 37. Thus, the front engagement element 39 and the rear engagement element 41 are disposed on opposite ends of the biasing element 37 such that the biasing element 37 is configured to bias the front engagement element 39 apart from the rear engagement element 41. In other implementations, the carriage engagement mechanism 18 is disposed at any suitable location on the carriage assembly 14. The carriage engagement mechanism 18 may include a plurality of carriage teeth 54. During operation, the rail engagement mechanism 16 may be selectively engaged by the front engagement element 39 of the carriage engagement mechanism 18, as shown in FIGS. 1, 2, and 7. For example, as shown, the plurality of rail teeth 52 may be configured to be selectively engaged by the plurality of carriage teeth 54. In other implementations, the carriage engagement mechanism 18 may include any suitable engagement mechanism, such as, for example, a mechanical fastener, a magnet, an electromagnet, a hook-and-loop fastener, a high-friction material, etc. configured to selectively engage the rail engagement mechanism 16.

Figure 5:
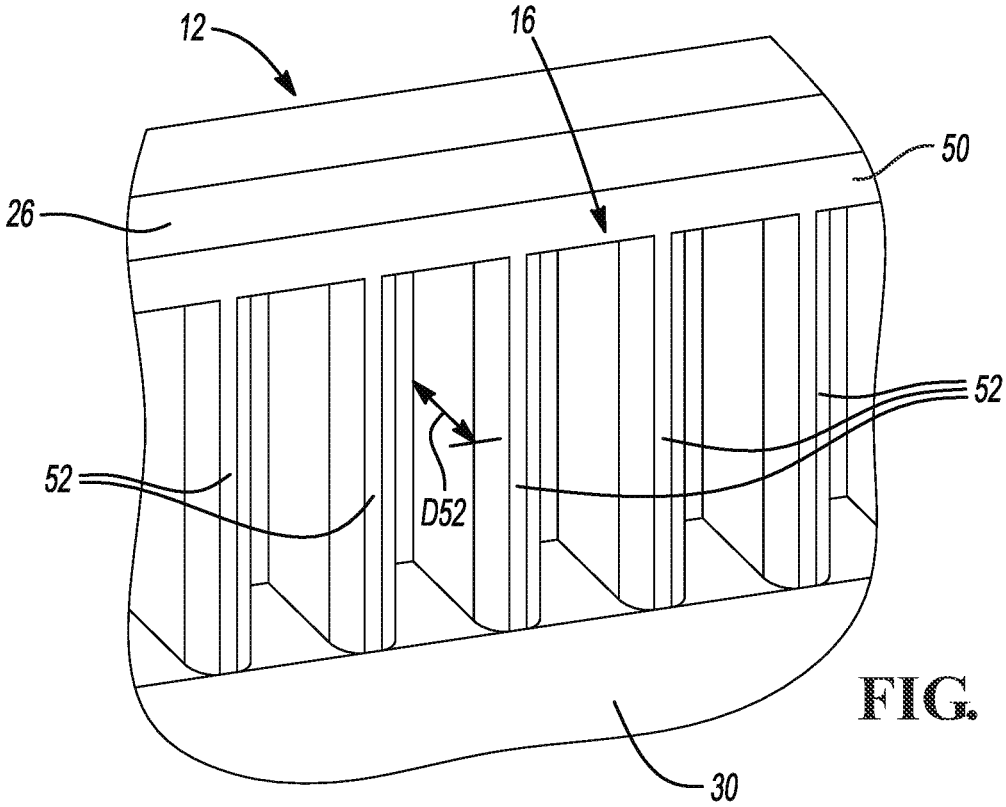
FIG. 5 is an enlarged view of a portion of the rail of FIG. 1.

Referring to FIGS. 5-7, the carriage teeth 54 of the carriage engagement mechanism 18 may be generally low-profile relative to the rail teeth 52 of the rail engagement mechanism 16. For example, the carriage teeth 54 may have a height $H_{54}$ relative to a base surface 53 that is less than a depth $D_{52}$ between each of the rail teeth 52. In some implementations, the rail teeth 52 define a first cross-sectional shape extending in a plane substantially parallel to the depth $D_{52}$, while the carriage teeth 54 define a second cross-sectional shape extending in a plane substantially parallel to the height $H_{54}$. The first cross-sectional shape may be different than the second cross-sectional shape. For example, the first cross-sectional shape may define a substantially convex or semi-cylindrical configuration, while the second cross-sectional shape may define a substantially V-shaped, triangular, or frustoconical configuration, or vice versa. In some implementations, the rail teeth 52 include a pair of planar sidewalls defining a first cross-sectional shape, and the carriage teeth 54 include a pair of planar sidewalls defining the second cross-sectional shape. The sidewalls of the rail teeth 52 may define a first angle therebetween, and the sidewalls of the carriage teeth 54 may define a second angle therebetween. The value of the first angle may be different than the value of the second angle. For example, the first angle may be substantially equal to zero degrees, such that the sidewalls of the rail teeth 52 are substantially equal to one another, while the second angle may be between five degrees and one hundred seventy-five degrees, such that the sidewalls of the carriage teeth 54 are transverse to one another. In some implementations, the angle between the sidewalls of the second cross-sectional shape is substantially equal to ninety degrees.

In some implementations, the carriage teeth 54 may include a relatively soft resilient material having a lower durometer or modulus of elasticity than a material forming the base surface 53, whereby the carriage teeth may flex relative to the base surface 53 in response to a force, i.e., flex toward and away from the base surface 53. In other implementations, the rail teeth 52 may include the soft resilient material such that the rail teeth may flex relative to the front wall 26 of the rail 12 in response to a force. In other implementations still, both the rail teeth 52 and the carriage teeth 54 may include of the soft reseilient material such that they both flex in response to a force. The height $H_{54}$ of the carriage teeth 54 may be high enough to prohibit transverse movement of the carriage assembly 14 along the rail 12 in the first direction $D_1$ by causing engagement, or contact, between the rail teeth 52 and the carriage teeth 54, however, the height $H_{54}$ of the carriage teeth 54 may be low enough to allow the carriage assembly 14 to translate along the rail 12 in the first direction $D_1$ after a force exerted upon the carriage assembly 14 in the first direction $D_1$ is sufficient to overcome the engagement, or contact, between the rail teeth 52 and the carriage teeth 54. In this regard, the arrangement of the first and carriage teeth 52, 54 (e.g., the first and second cross-sectional shapes, the angles defined by the respective sidewalls, the height $H_{54}$ and depth $D_{52}$, etc.) may allow the rail teeth 52 to be disposed in a void between adjacent ones of the carriage teeth 54, and vice versa, without the distal ends of the carriage teeth 54 engaging a portion of the front wall 26 disposed between such adjacent rail teeth 52, and/or without the distal ends of the rail teeth 52 engaging the base surface 53.

Figure 4:
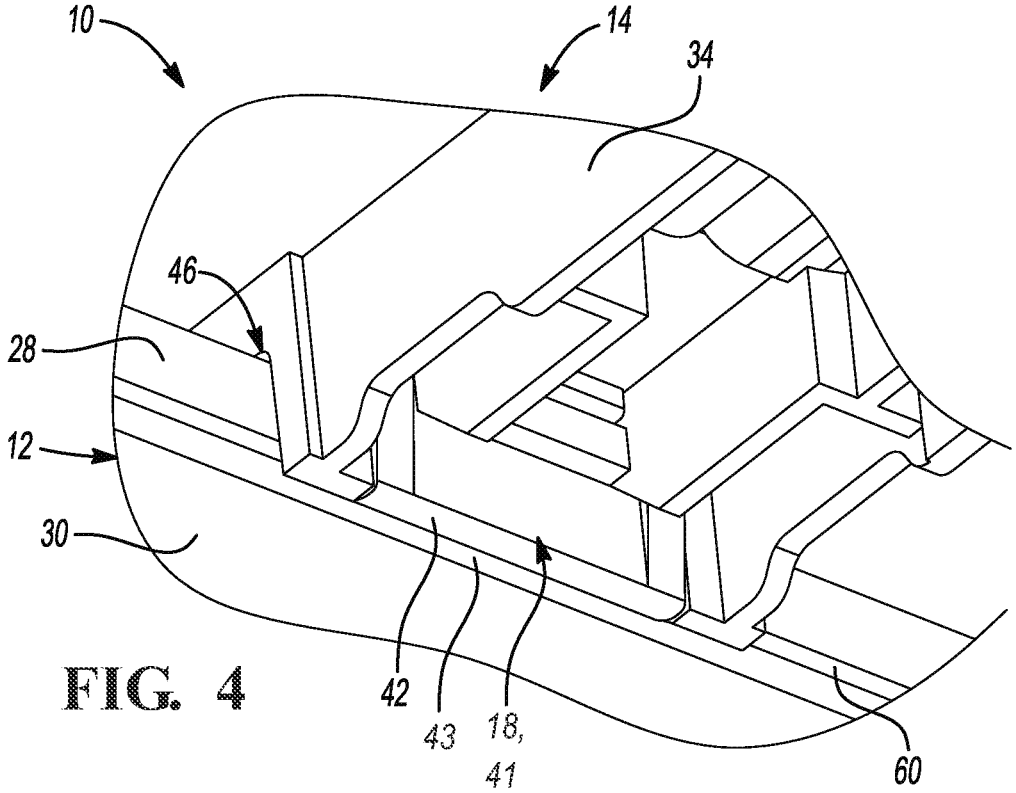
FIG. 4 is a bottom rear perspective view of the rail and the divider of FIG. 1.
Figure 12:
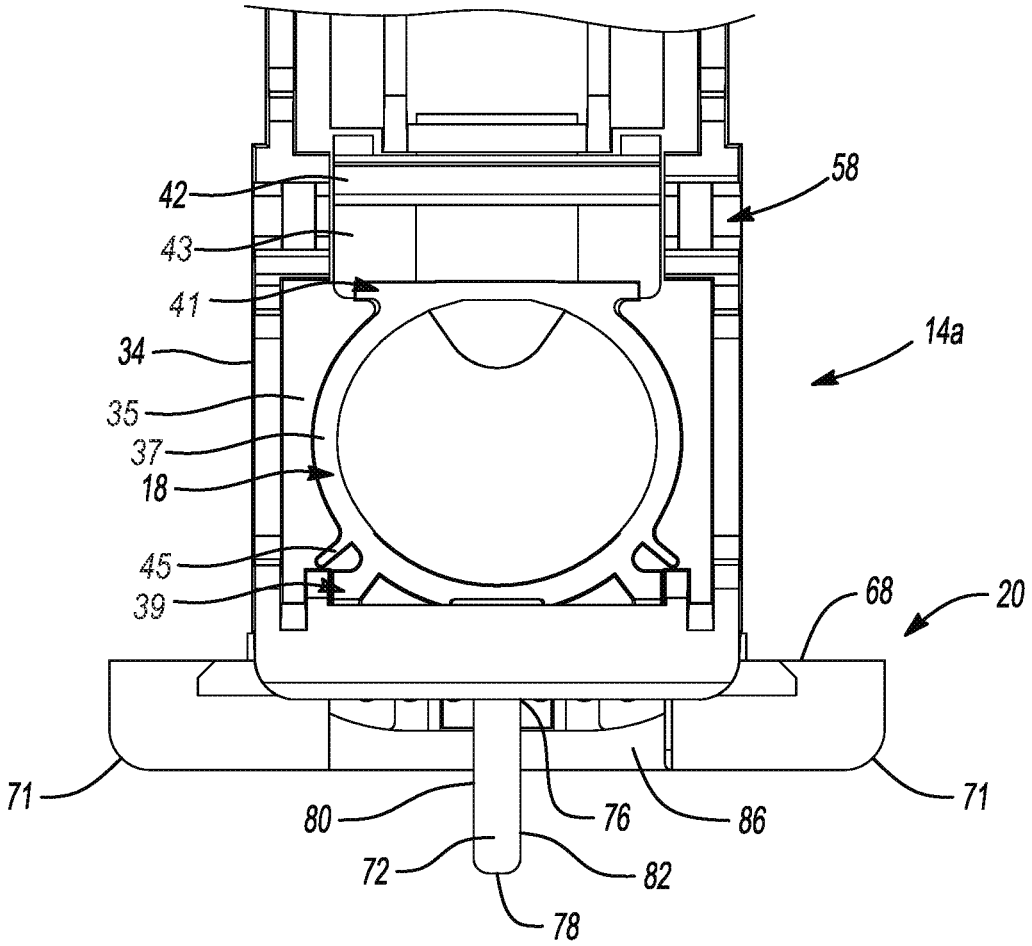
FIG. 12 is a bottom view of the product divider of FIG. 8.

Referring to FIGS. 3 and 4 and FIG. 12 (where the carriage engagement mechanism 18 is illustrated in connection with a second example of a carriage assembly 14*a*), the carriage engagement mechanism 18 includes several elements to maintain alignment or orientation of the carriage engagement mechanism 18 during use. For example, the carriage assembly 14 may include a wall engagement feature 42 and one or more stabilizers 45. As best shown in FIG. 3, the wall engagement feature 42 of the carriage assembly 14 may be integrated into the rear engagement element 41 of the carriage engagement mechanism 18. Particularly, the wall engagement feature 42 may be spaced apart from the second end of the biasing element 47 to define a groove or rear track 43 between the wall engagement feature 42 and the second end of the biasing element 37.

As shown in FIG. 4, the rear track 43 of carriage engagement mechanism 18 is configured to receive a portion of the rear wall 28 of the rail 12 when the carriage assembly 14 is assembled to the rail 12. In other words, the rear track 43 is aligned with the slot 46 of the carriage base 34 to provide a continuous channel extending across the width of the carriage assembly 14 in the second direction $D_2$. Thus, the rear track 43 of the carriage engagement mechanism 18 and the slot 46 of the carriage base 34 cooperate to each receive a portion of the rear wall 28 of the rail 12.

The wall engagement feature 42 may be configured to slidably engage the rear wall 28 of the rail 12 to secure the carriage engagement mechanism 18 (and the carriage assembly 14) onto the rear wall 28. In this regard, the rear wall 28 may define a groove 60 extending in the first direction $D_1$ along the length of the rail 12. In an assembled configuration, the wall engagement feature 42 may be translatably disposed within the groove 60, while the carriage base 34 of the carriage assembly 14 may be translatably disposed within the channel 32 of the rail 12. That is, the wall engagement feature 42 may allow the carriage assembly 14 and the carriage engagement mechanism 18 to translate (e.g., slide) along the first direction $D_1$, while inhibiting separation of the carriage assembly 14 from the rail 12 in a vertical direction $D_3$ (e.g., a direction perpendicular to the first and second directions $D_1$, $D_2$). Providing the interface between the rear wall 28 of the rail 12 and the rear track 43 of the carriage engagement mechanism 18 functions to maintain the orientation of carriage engagement mechanism 18 relative to the rail 12 when the carriage assembly 14 is translated along the rail 12. For example, when the carriage assembly 14 is translated along the rail 12 without fully disengaging the carriage teeth 54 from the rail teeth 52, the interference between the teeth 52, 54 may create a counteractive force on the front engagement element 39 in a direction opposing the direction of translation. This counteractive force may include a torsional force component that causes the carriage engagement mechanism 18 to rotate within the cavity 35. However, by providing the interface between the rear wall 28 and the rear track 43, rotation of the carriage engagement mechanism 18 is minimized to maintain alignment between the rail teeth 52 and the carriage teeth 54.

In addition to the rear engagement element 41, the carriage engagement mechanism 18 may include a pair of the stabilizers 45 disposed at the first end of the biasing element 37. Each of the stabilizers 45 extends outwardly to a distal end that engages a front wall portion of the carriage base 34 of the carriage assembly 14. The stabilizers 45 function as both (i) a positive stop to prevent over-extension of the biasing element 37 and the front engagement element 39 and (ii) as alignment aids to maintain a rotational orientation of the carriage engagement mechanism 18 relative to the carriage base 34.

With reference to FIGS. 1 and 2, the carriage assembly 14 may include a pair of gripping members 44 disposed at or near the front portion 20. The gripping members 44 may be defined by generally arcuate or concave cutouts or voids disposed on opposite sides of the stopper 38. In some implementations, the gripping members include a plurality of ridges, a high-friction material, or any other suitable gripping member 44. The gripping members 44 may facilitate pushing and pulling of the carriage assembly 14 along the first direction $D_1$ by allowing a user's fingers to comfortably and efficiently engage opposite side of the stopper 38.

In some implementations, the pusher extends in the second direction $D_2$ and is coupled to the rail 12 in a manner substantially similar to the carriage assembly 14 (i.e., via the carriage base 34) or in any suitable manner. Likewise, the pusher may include a third engagement mechanism substantially similar to the carriage engagement mechanism 18, such that the pusher is selectively translatable long the rail 12 in the first direction $D_1$ similar to the carriage assembly 14. Alternatively, the pusher may translate along the rail 12 in any suitable manner, e.g., sliding freely along the rail 12, or may be fixed to the rail 12.

The components of the product management system 10, i.e., the rail 12, the carriage assembly 14, and the pusher, and associated components thereof, may be formed of any suitable material(s). These components may be formed of the same material, different materials, or some combination of the two. For example, these components may be formed of a plastic, a metal, carbon fiber, etc. These components may be formed by or implementing any suitable process, such as, for example, injection molding, 3-D printing, welding, gluing, mechanical fastening, etc.

As set forth above, the product management system 10 may be implemented on a shelf or other suitable surface of a store or any suitable storage location. For example, two carriage assemblies 14 may be spaced from each other, and a pusher may be disposed between the two carriage assemblies 14, such that the carriage assemblies 14 and/or pusher can be translated along the rail 12 to allow products to be inserted into the product management system 10. For example, wide products may require the carriage assemblies 14 to be translated along the rail 12 in the first direction $D_1$ away from each other, and narrow products may require the carriage assemblies 14 to be translated along the rail 12 in the first direction $D_1$ toward each other. To translate the carriage assembly 14, a user may grasp the carriage assembly 14, for example at the gripping members 44, and push or pull the carriage assembly 14 along the first direction $D_1$. The engagement of the rail teeth 52 and the carriage teeth 54 may initially resist movement of the carriage assembly 14 along the rail 12. However, upon the user exerting a sufficient force upon the carriage assembly 14, the teeth 52, 54, and/or any other suitable component of the rail 12 and/or the carriage assembly 14, may briefly flex to allow the divider to translate along the rail 12, i.e., until one of the carriage teeth 54 engages with an adjacent one of the rail teeth 52. After flexing, the teeth 52, 54, and/or any other suitable component of the rail 12 and/or the carriage assembly 14, may return to their natural state to again inhibit movement of the carriage assembly 14 along the rail 12. Then, the foregoing process may repeat. In real-time, the foregoing process may occur relatively quickly such that the carriage assembly 14 may translate along the rail 12 in a relatively continuous or fluid manner. Alternatively, the carriage teeth 54 may engage with the rail teeth 52 such that the movement of the carriage assembly 14 is jerky or choppy, with each one of the carriage teeth 54 sequentially engaging with each adjacent tooth of the rail teeth 52, e.g., similar to a ratcheting mechanism.

Referring now to FIGS. 8-12, another carriage assembly **14*a* for use with the rail 12 and/or a pusher (not shown) is provided. In view of the substantial similarity in structure and function of the components associated with the carriage assembly 14*a* relative to the carriage assembly 14**, like reference numerals are used hereinafter and in the drawings to identify like components while like reference numerals containing letter extensions are used to identify those components that have been modified.

Figure 10:
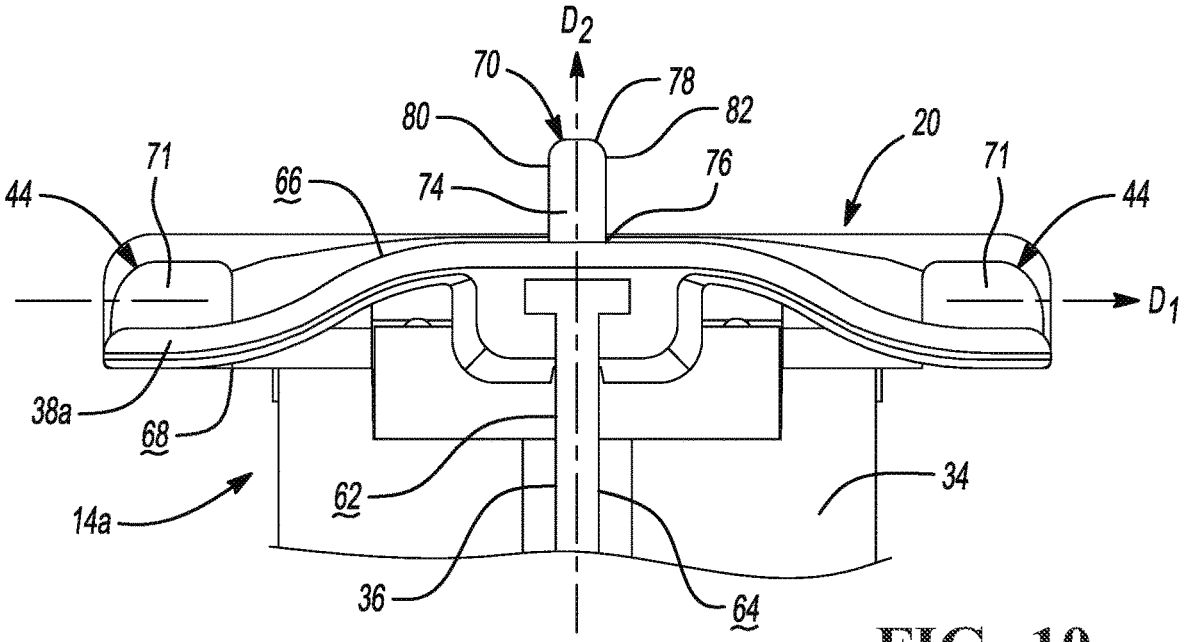
FIG. 10 is a top view of the product divider of FIG. 8.
Figure 11:
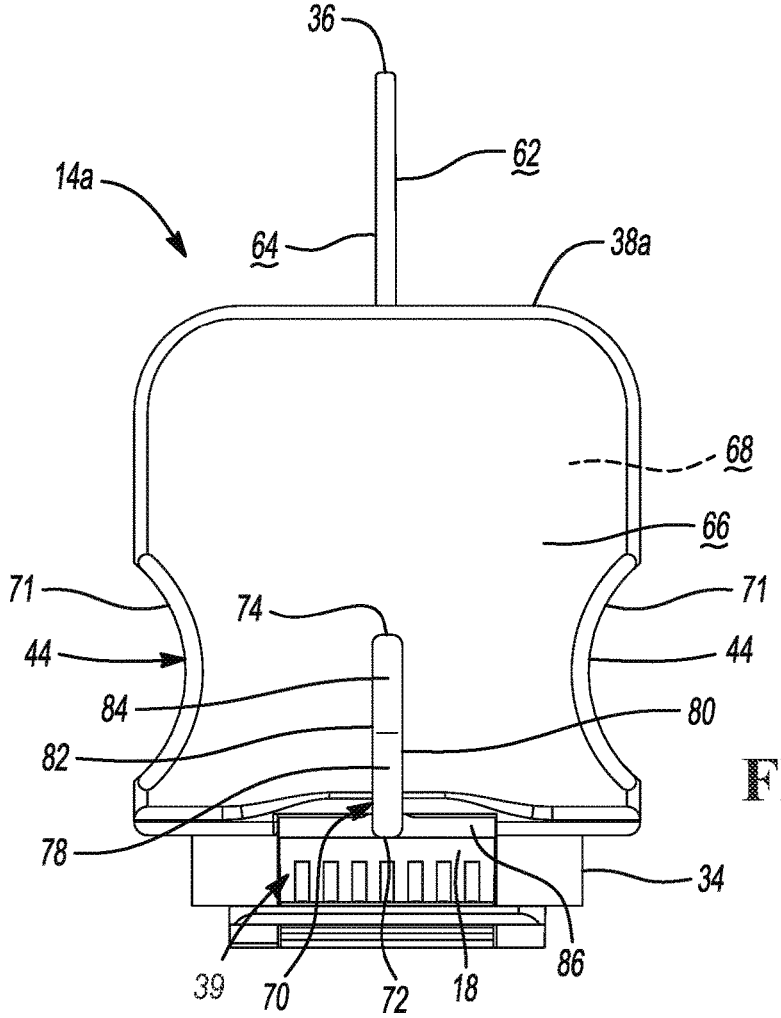
FIG. 11 is a front view of the product divider of FIG. 8.

With reference to FIG. 10, the carriage assembly **14*a* may extend in the second direction $D_2$ perpendicular to the first direction $D_1$ and may be coupled to the rail 12 for translation in the first direction $D_1$. Specifically, the rail 12 includes the rail engagement mechanism 16 and the carriage assembly 14*a* includes the carriage engagement mechanism 18 (FIGS. 11-12) configured to engage with the rail engagement mechanism 16. The engagement mechanisms 16, 18 may be configured to enable the carriage assembly 14*a* to selectively translate along the rail 12** in the first direction $D_1$.

The carriage assembly **14*a* further includes the carriage base 34, the dividing wall 36, and a stopper 38*a*. The dividing wall 36 may include a first side surface 62 and a second side surface 64 opposite the first side surface 62. In some implementations the first side surface 62 is substantially (e.g., +/−5 degrees) parallel to the second side surface 64. In this regard, the first and second side surfaces 62, 64 may extend in the same direction. For example, in the assembled configuration (e.g., FIG. 1), the first and second side surfaces 62, 64 may extend in the second direction $D_2$. In some implementations, the first side surface 62 and/or the second side surface 64** is substantially planar.

The stopper **38*a* is disposed at or near the front portion 20 to cooperate with the pusher to hold products in place. The stopper 38*a* may include a front surface 66, a rear surface 68 opposite the front surface 66, the pair of gripping members 44, and a flange 70 disposed at or near the front portion 20. The gripping members 44 may each include an arcuate flange 71 extending from the front surface 66 of the stopper 38*a***.

The flange 70 may include a bottom end 72, a top end 74 opposite the bottom end 72, a rear end 76 extending between the bottom and top ends 72, 74, a front end 78 opposite the rear end 76 and extending between the bottom and top ends 72, 74, a first lateral side 80 extending between the bottom, top, rear, and front ends 72, 74, 76, 78, and a second lateral side 82 opposite the first lateral side and extending between the bottom, top, rear, and front ends 72, 74, 76, 78. At least one of the top and front ends 74, 78 may include an arcuate portion 84. For example, the arcuate portion 84 may define a radius of curvature extending from the top end 74 and the front end 78. In some implementations, the top end 74 and/or the front end 78 may extend tangentially from the arcuate portion 84 to provide improved comfort and maneuverability by the user applying a force on the flange 70. In some implementations the bottom end 72 extends from, and is coplanar with, a lower edge 86 of the stopper **38*a* to improve coupling of the carriage assembly 14*a* to the rail 12** in the assembled configuration.

The first and second lateral sides 80, 82 may extend from the stopper **38*a* (e.g., the front surface 66) in a direction transverse to the first direction $D_1$. In some implementations, the first and/or second lateral sides 80, 82 define a planar configuration extending from the stopper 38*a* in a direction substantially (e.g., +/−5 degrees) perpendicular to the first direction $D_1$ and substantially (e.g., +/−5 degrees) parallel to the second direction $D_2$. During use, to translate the carriage assembly 14***a* relative to the rail 12, a user may grasp the carriage assembly 14*a* and push or pull the carriage assembly 14*a* along the first direction $D_1$. The configuration of the flange 70 (e.g., the first and second lateral sides 80, 82) can allow a user to more easily grasp the carriage assembly 14*a* and apply a force in a direction transverse to the second direction $D_2$, thus allowing the user to adjust the position of the carriage assembly 14*a* relative to the rail 12, as previously described. In particular, the configuration of the flange 70 can allow the user to translate the carriage assembly 14*a* in the first direction $D_1$ without causing the carriage assembly 14*a* to rotate relative to the first and/or second direction $D_1$, $D_2$.

Referring now to FIGS. 13-20, another carriage assembly 14*b* for use with the rail 12 and/or a pusher (not shown) is provided. In view of the substantial similarity in structure and function of the components associated with the carriage assembly 14*b* relative to the carriage assembly 14, like reference numerals are used hereinafter and in the drawings to identify like components while like reference numerals containing letter extensions are used to identify those components that have been modified.

Figure 13:
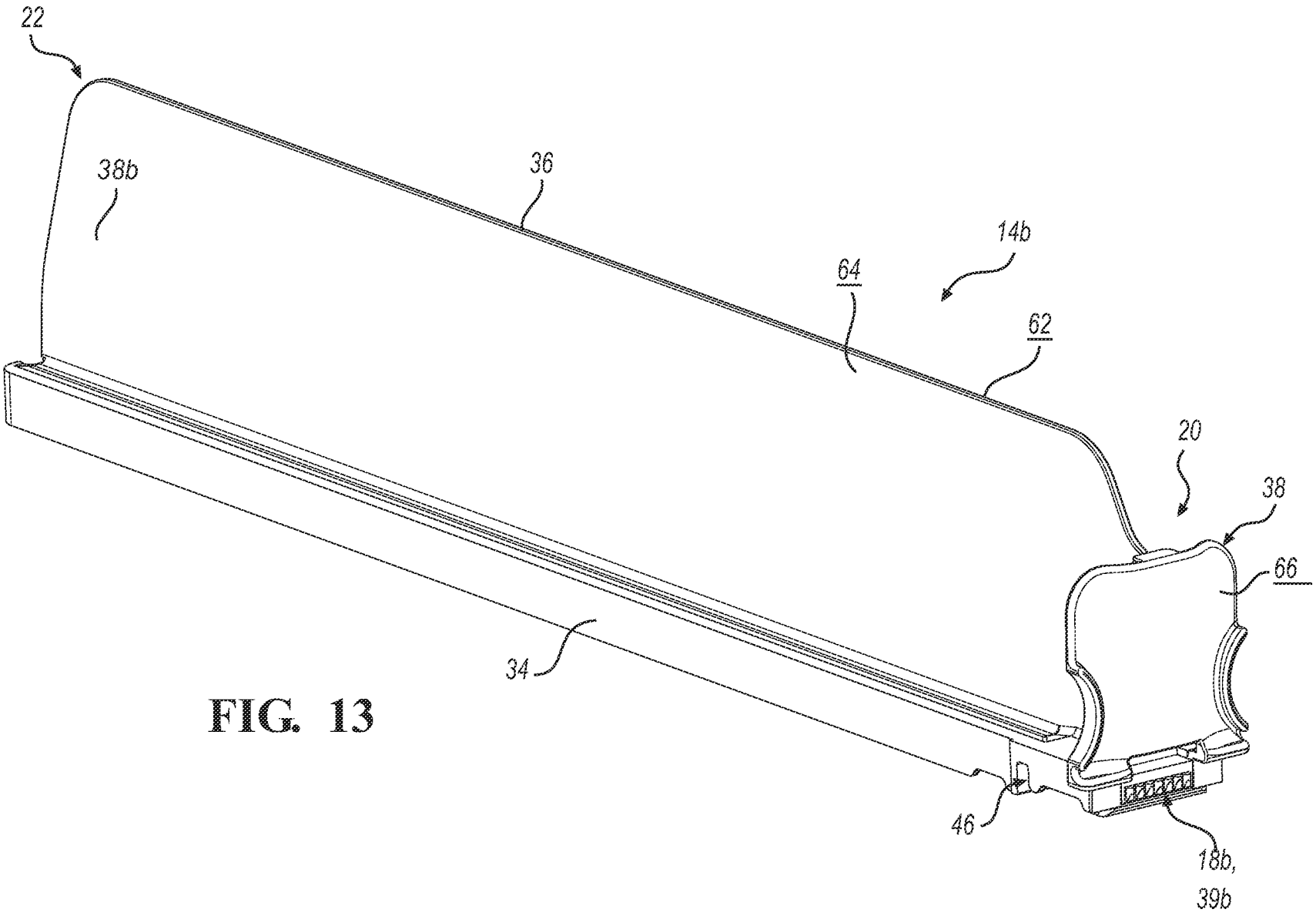
FIG. 13 is a top front perspective view of a product carriage assembly including a rail and a divider in accordance with the principles of the present disclosure.
Figure 14:
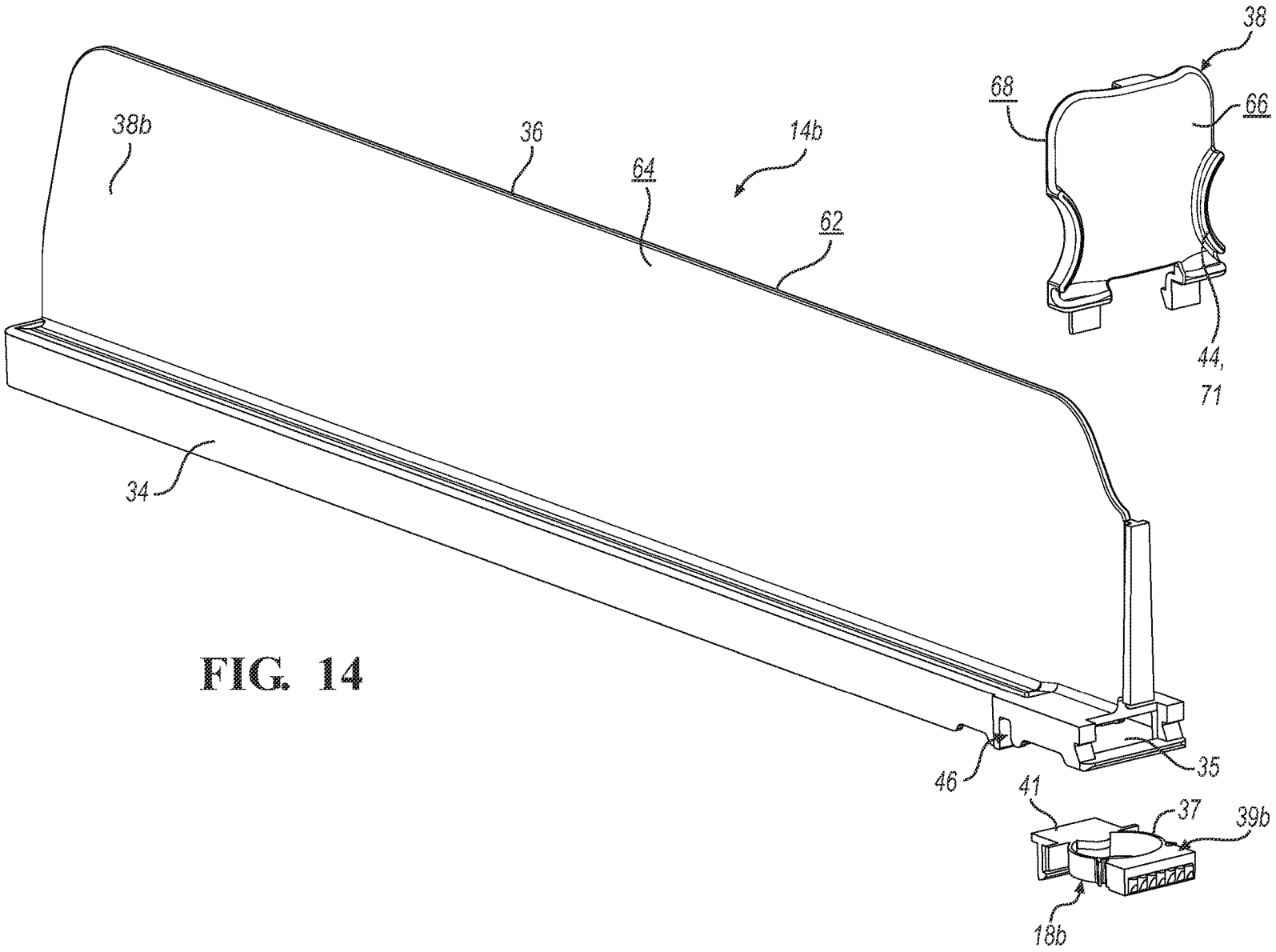
FIG. 14 is an exploded top front perspective view of the product carriage assembly of FIG. 13.
Figure 15:
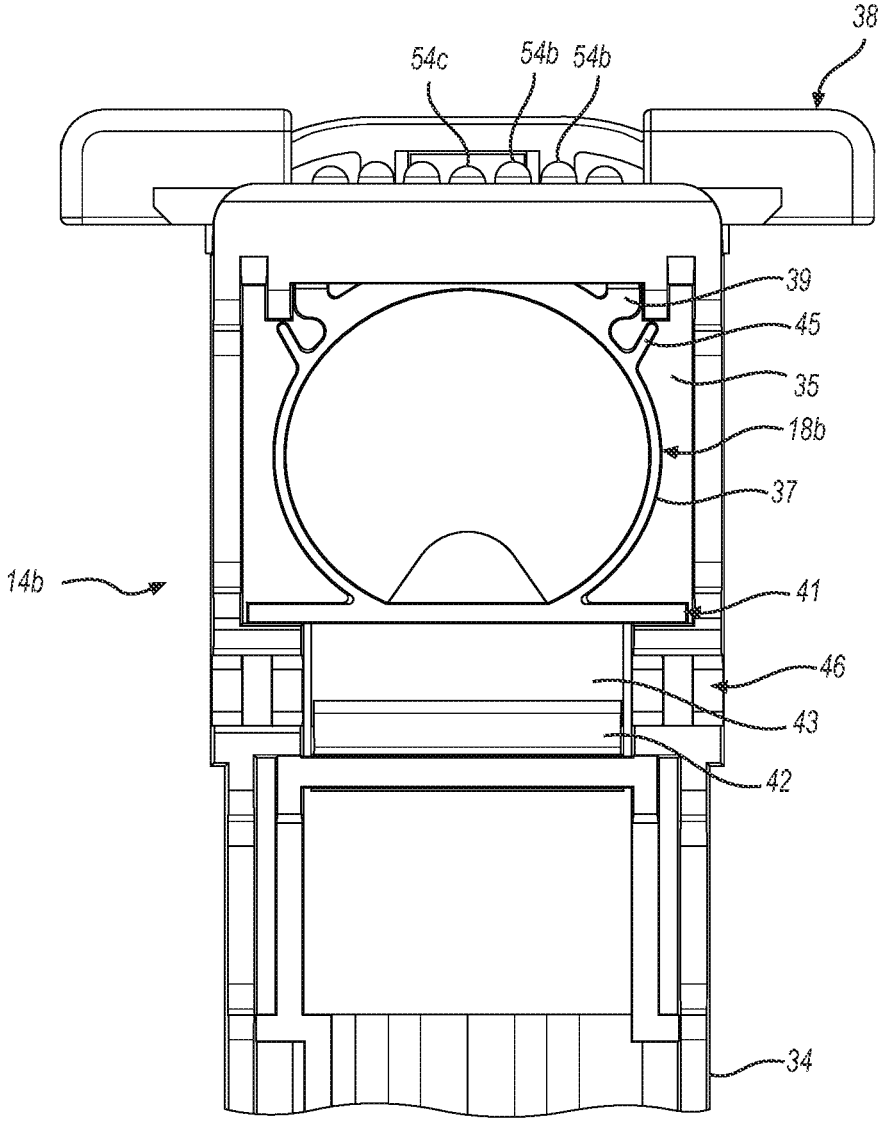
FIG. 15 is a fragmentary bottom plan view of the product carriage assembly of FIG. 13.
Figure 16:
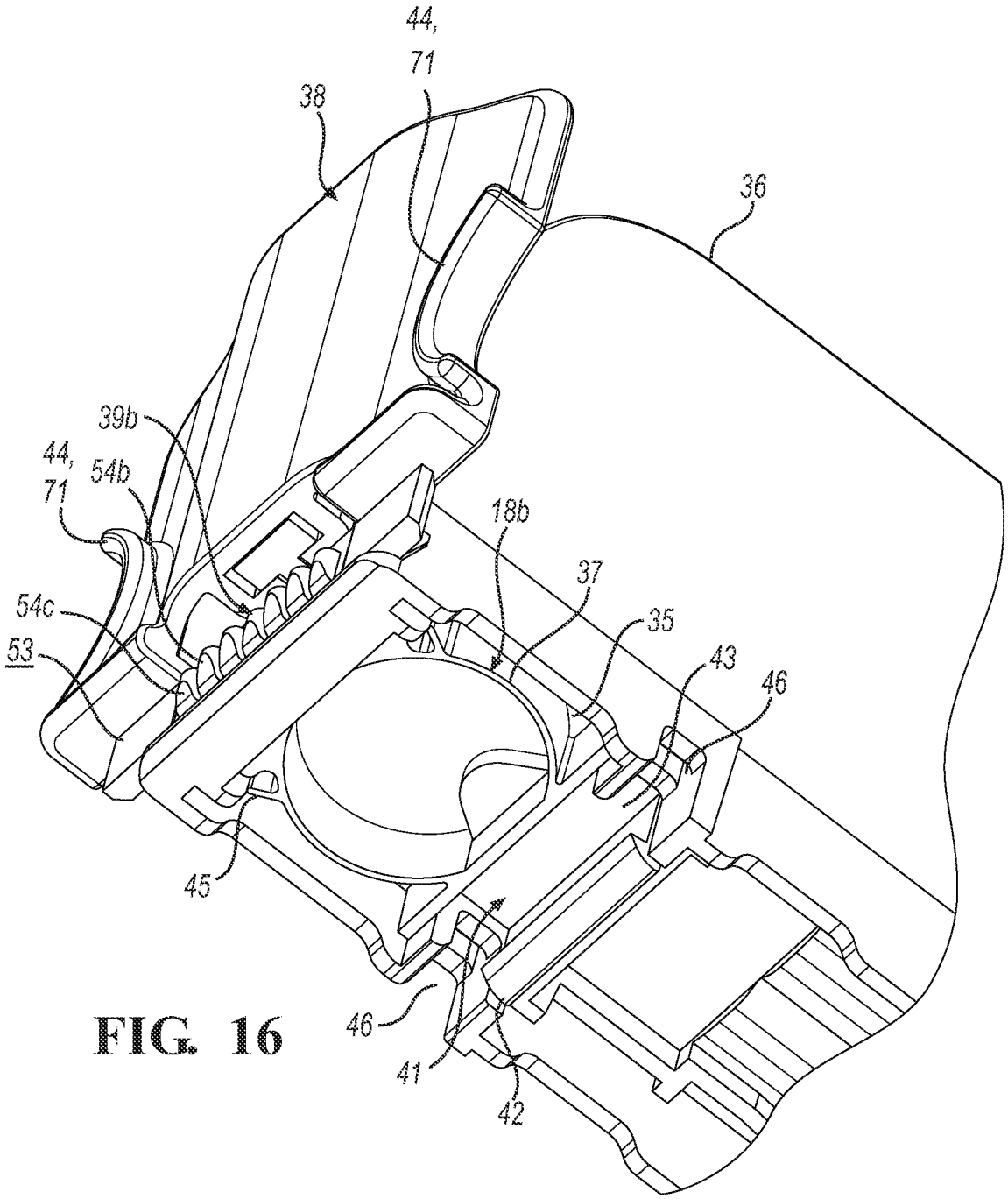
FIG. 16 is a fragmentary bottom perspective view of the product carriage assembly of FIG. 13.

With reference to FIG. 13, the carriage assembly 14*b* includes a carriage base 34*b* having a carriage engagement mechanism 18*b* (FIGS. 15-20) configured to engage with the rail engagement mechanism 16 of the rail 12 shown in FIGS. 1-3. The engagement mechanisms 16, 18*b* may be configured to enable the carriage assembly 14*b* to selectively translate along the rail 12 in the first direction $D_1$ without actively disengaging the carriage engagement mechanism 18*b* from the rail engagement mechanism 16. In other words, the carriage engagement mechanism 18*b* is configured such that a user can translate the carriage assembly 14*b* along the rail 12 by applying a lateral translation force $F_1$ (i.e., in the first direction $D_1$), whereby the carriage engagement mechanism 18*b* remains partially engaged with the rail engagement mechanism 16 during the movement to provide a desired resistance force $F_R$ in an opposite direction of the lateral translation force $F_1$. This feature is described in greater detail below with respect to the configuration of the carriage engagement mechanism 18*b*.

The carriage assembly 14*b* further includes the carriage base 34*b*, the dividing wall 36, and the front stopper 38. The front stopper 38 is disposed at or near the front portion 20 to cooperate with the pusher to hold products in place. The front stopper 38 may include a front surface 66*b*, arear surface 68*b* opposite the front surface 66*b*, and a pair of gripping members 44. In this example, the gripping members 44 include a pair of arcuate ribs 44 extending from the front surface 66*b* of the stopper 38*b*. While not shown in the illustrated example, the stopper 38 may optionally include the flange 70 described previously with respect to FIGS. 8-12. Optionally, the carriage assembly 14*b* may include a rear stopper 38*b* attached to the carriage base 34*b* and/or the divider wall 36 between the front portion 20 and the rear portion 22 of the carriage assembly 14*b*. The rear stopper 38*b* includes a panel or protrusion attached to the carriage base 34*b* and/or the divider wall 36 and is configured to obstruct a product receiving area of the product management system 10, thereby preventing products loaded into the product management system 10 from being pushed beyond the rear portion 22 of the carriage assembly. In some examples, a position of the rear stopper 38*b* may be adjusted along the second direction $D_2$ to provide the product receiving area of the product management system 10 with a desired depth (i.e., distance measured from the front portion 20 along the second direction $D_2$).

With reference to FIGS. 15-20, the carriage engagement mechanism 18*b* of the present example is substantially similar to the carriage engagement mechanism 18 set forth above. Thus, the carriage engagement mechanism 18*b* includes the biasing element 37, a front engagement element 39*b* defining a plurality of carriage teeth 54*b*, 54*c*, the rear engagement element 41 including the wall engagement feature 42 and the rear track 43.

Figure 18:
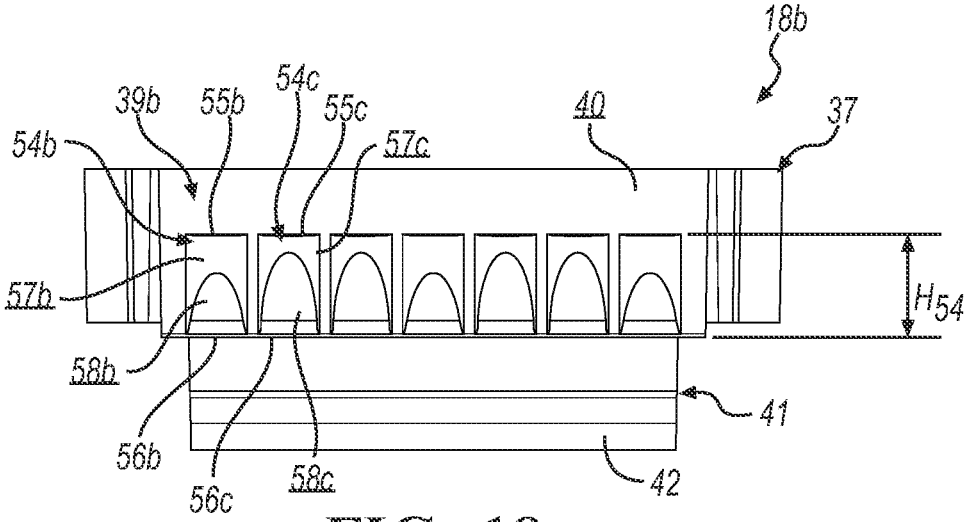
FIG. 18 is a front elevation view of a carriage engagement mechanism according to an example of the present disclosure, which may be incorporated into any of the product management systems shown in FIGS. 1-17.
Figure 19:
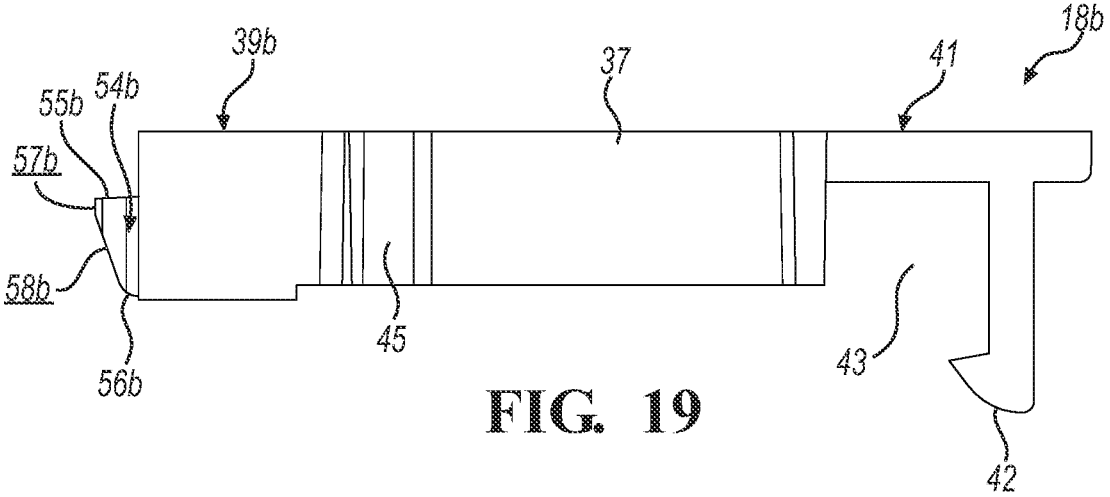
FIG. 19 is a side elevation view of the carriage engagement mechanism of FIG. 18.
Figure 20:
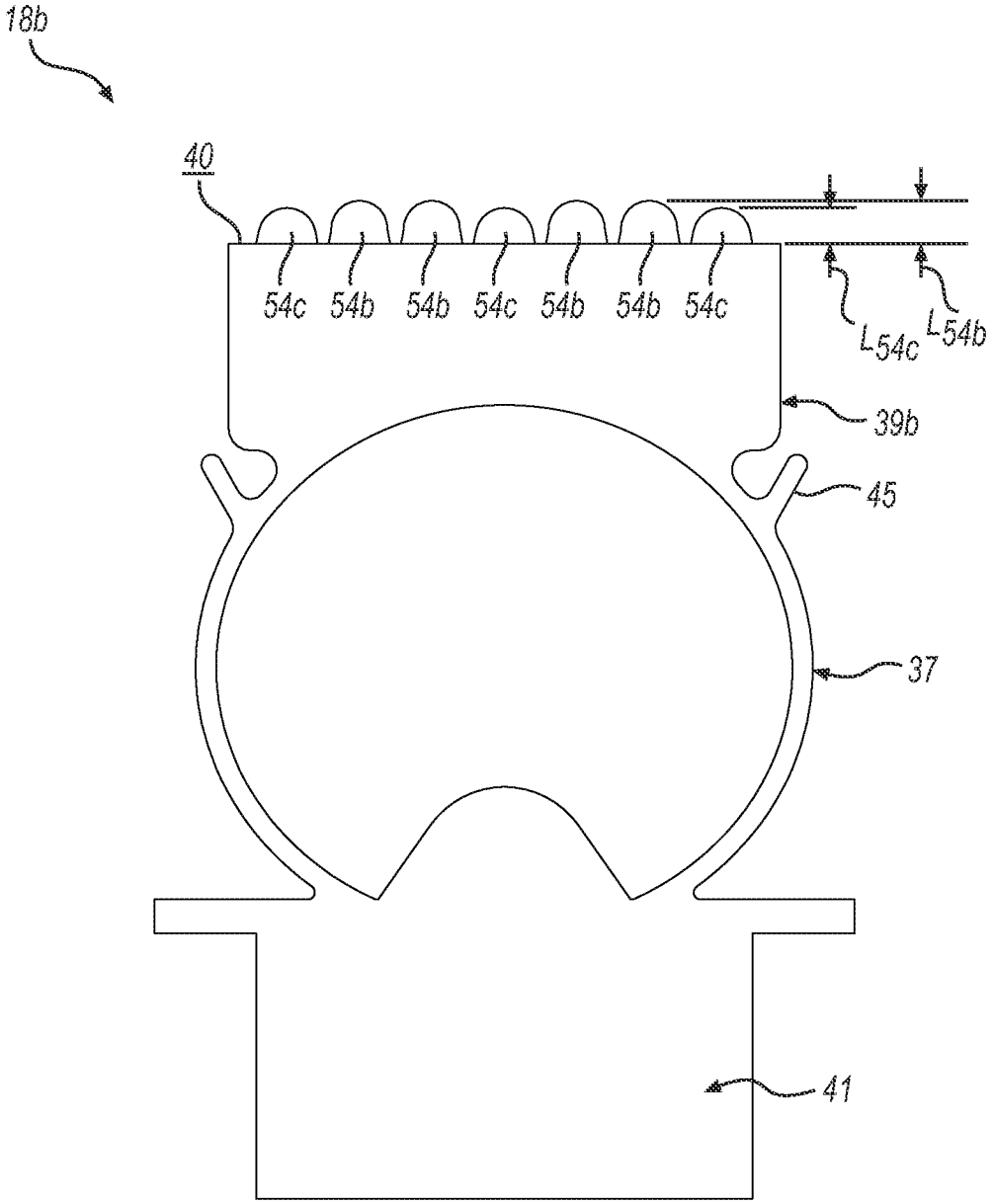
FIG. 20 is a top plan view of the carriage engagement mechanism of FIG. 18.
Figure 21:
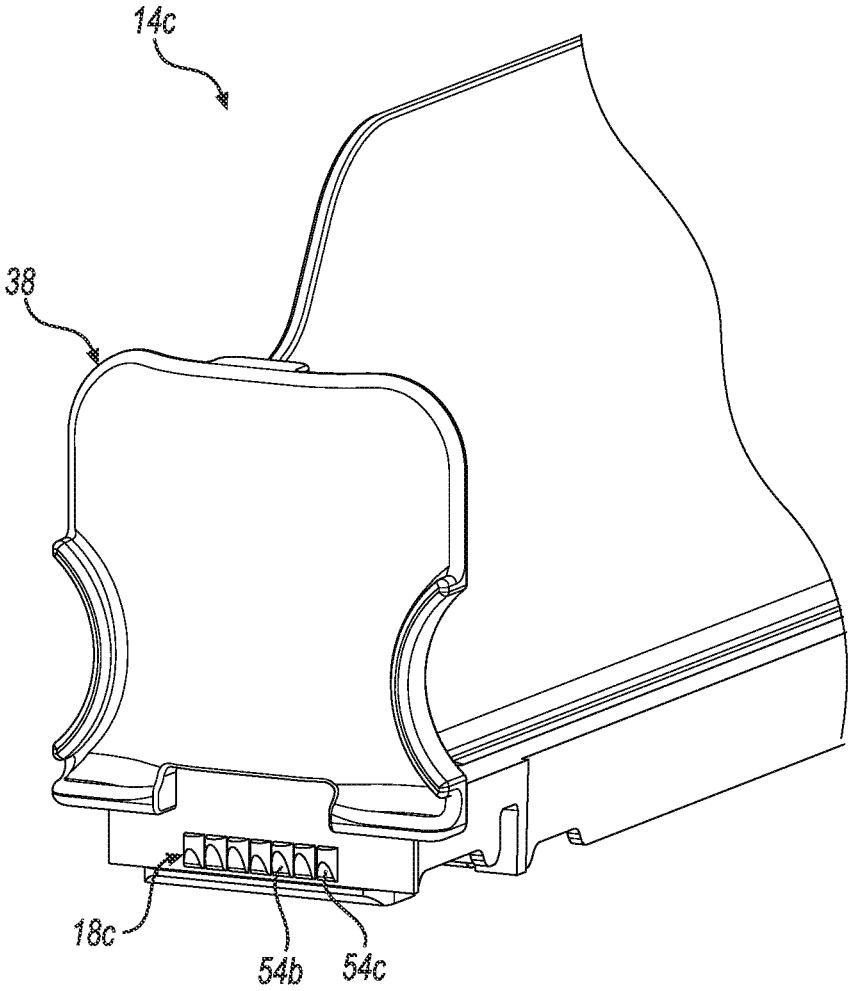
FIG. 21 is a fragmentary top front perspective view of a product carriage assembly in accordance with the principles of the present disclosure.
Figure 22:
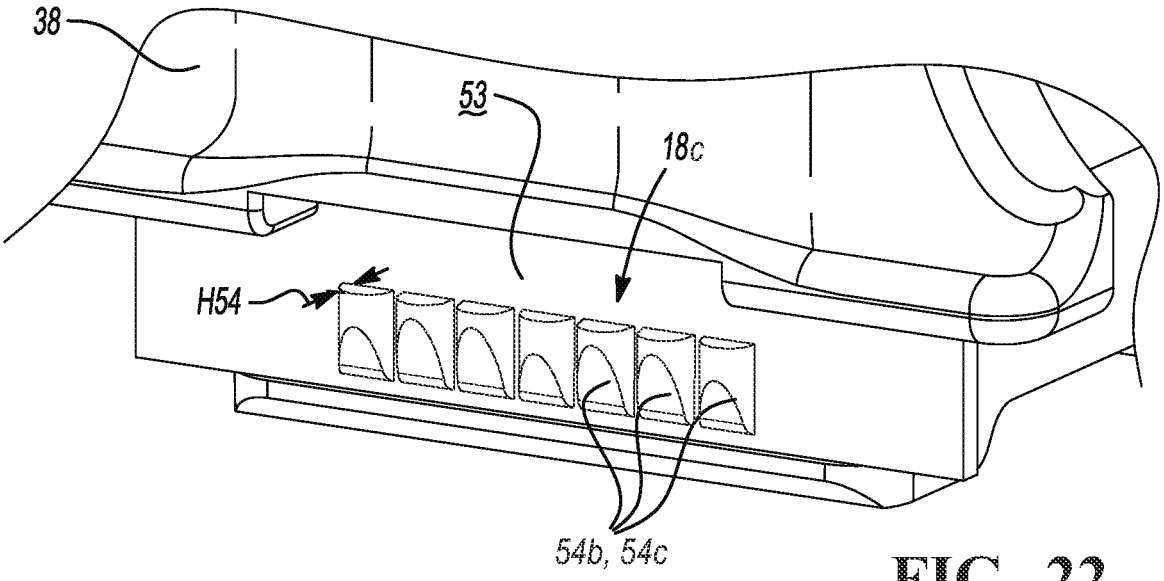
FIG. 22 is an enlarged view of a portion of the divider of FIG. 21.
Figure 23:
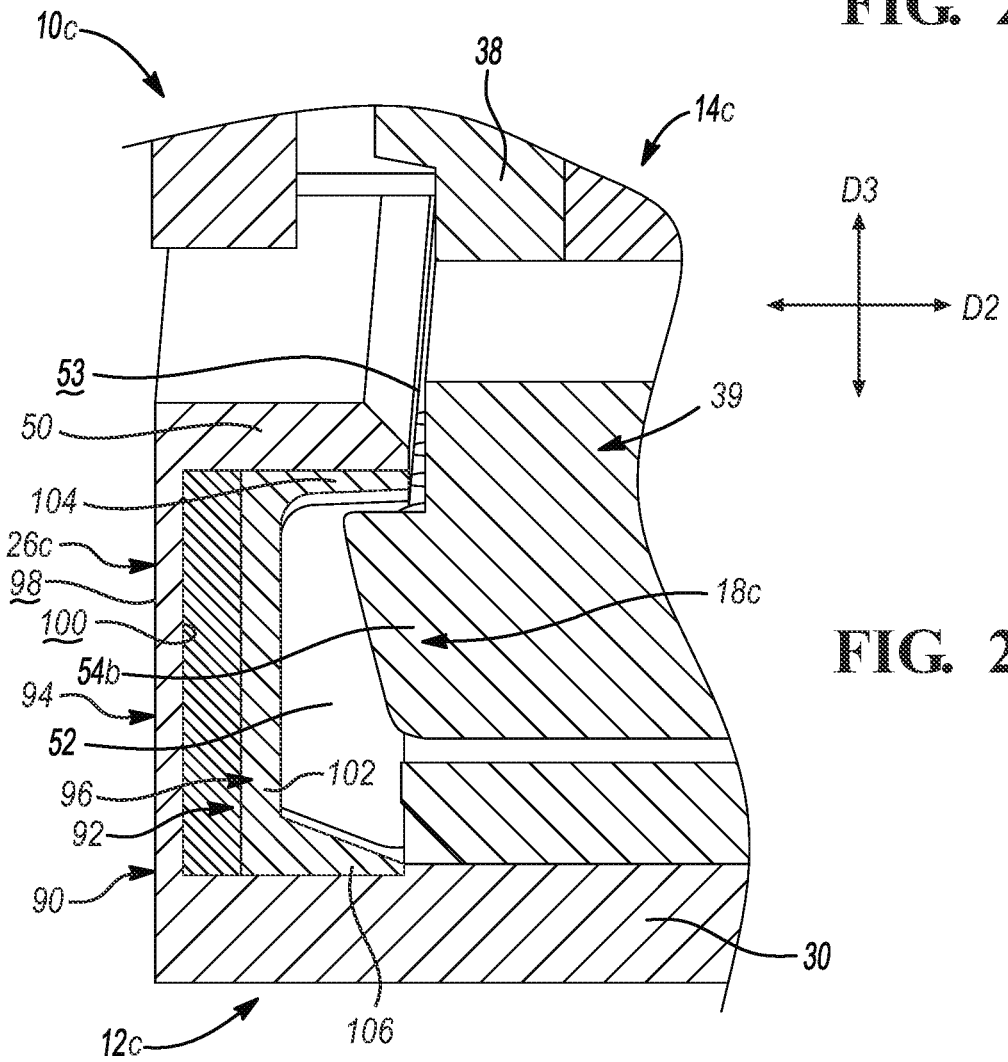
FIG. 23 is a cross-sectional view showing the product carriage assembly of FIG. 21 engaged with an example of a rail according to the principles of the present disclosure.
Figure 24:
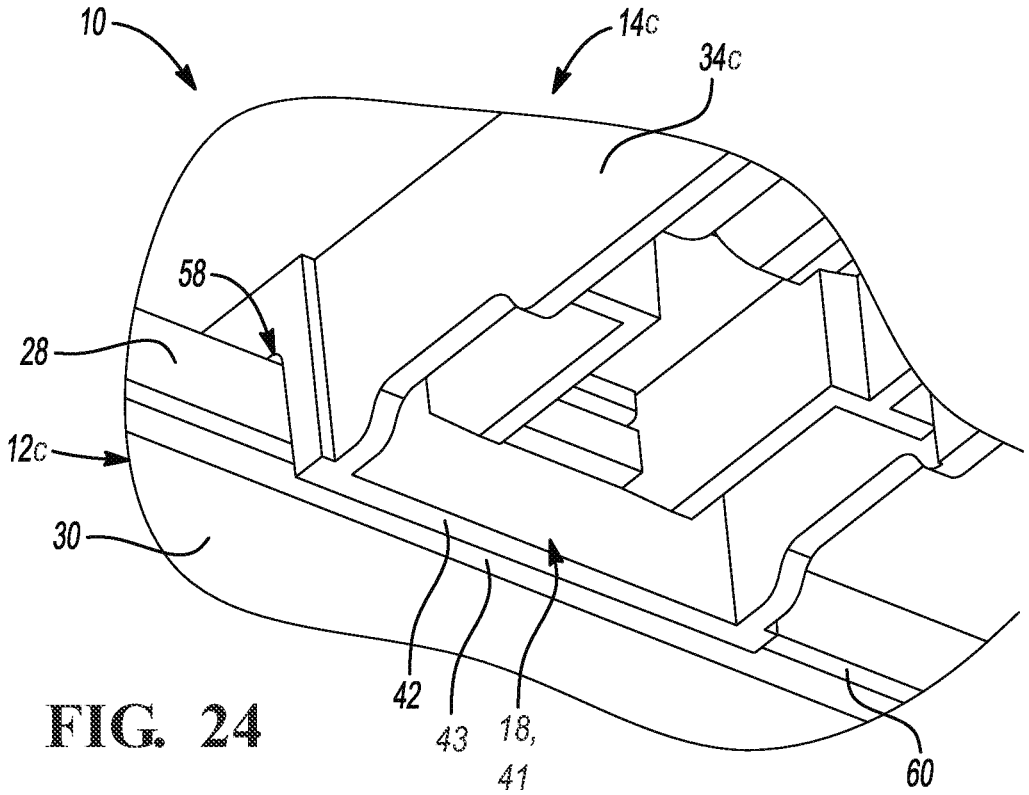
FIG. 24 is a bottom rear perspective view of the product carriage assembly of FIG. 21, showing the product carriage assembly engaged with a rail according to the principles of the present disclosure.
Figure 25:
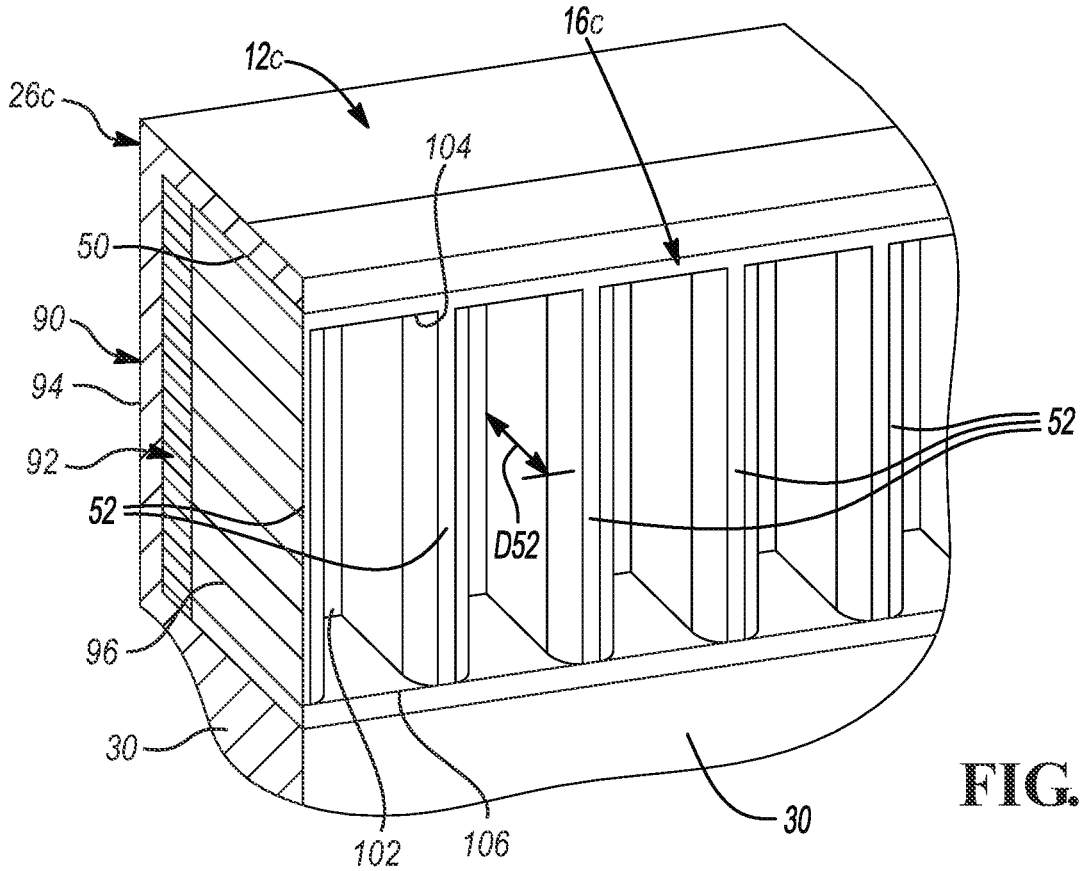
FIG. 25 is an enlarged perspective view of an example of the rail provided in FIG. 23.
Figure 26:
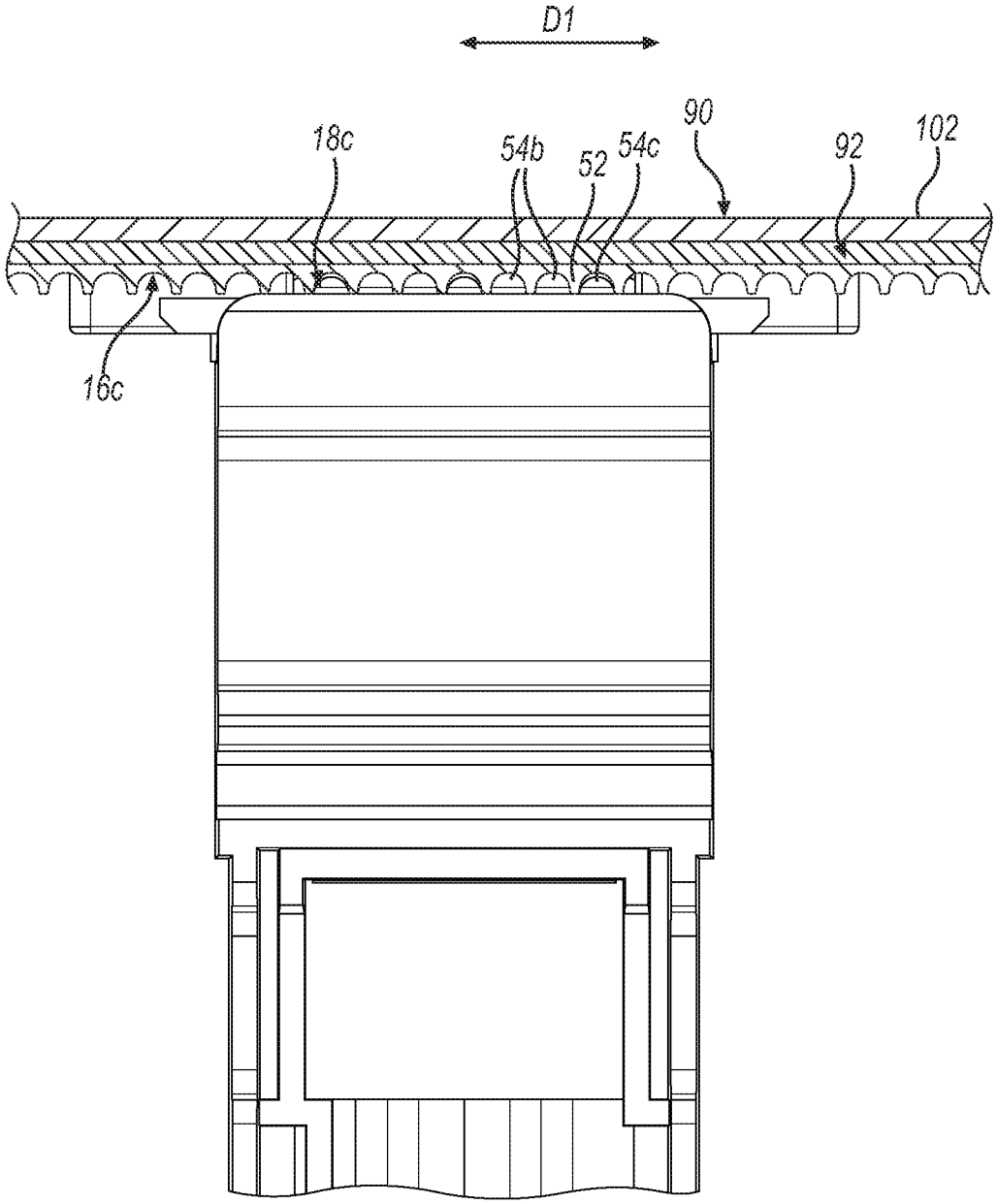
FIG. 26 is a bottom plan view showing the product carriage assembly and rail of FIG. 23.

Referring to FIGS. 18-20, the carriage engagement mechanism 18*b* of this example is provided with primary carriage teeth 54*b* and secondary carriage teeth 54*c*, as discussed below. Generally, each of the carriage teeth 54*b*, 54*c* has a height $H_{54}$ that extends from a top end 55*b*, 55*c* to a bottom end 56 along a third direction $D_3$ that generally corresponds to a vertical direction perpendicular to each of the first direction $D_1$ and the second direction $D_2$. The primary carriage teeth 54*b* have a different configuration (e.g., size, shape, material) than the secondary carriage teeth 54*c* to provide the primary carriage teeth 54*b* with different operating characteristics than the secondary carriage teeth 54*c*. For example, the primary carriage teeth 54*b* may be configured to provide greater engagement with the rail in one or both of the lateral direction $D_1$ or the vertical direction $D_2$.

The top end 55*b*, 55*c* of each carriage tooth 54*b*, 54*c* defines a generally horizontal surface (i.e., extending in the plane of $D_1$ and $D_2$) that extends perpendicular from a front surface of the carriage base 34. The top end 55*b*, 55*c* of each carriage tooth 54*b*, 54*c* is configured to interface with an upper flange 50 of the rail 12 when the carriage assembly 14*b* is installed on the rail 12 to prevent inadvertent disengagement of the carriage assembly 14*b* from the rail 12 in the vertical direction $D_3$. The interface between the top ends 55*b*, 55*c* of the carriage teeth 54*b*, 54*c* and the upper flange 50 of front wall 26 provides both vertical retention and torsional stability to the front portion of the carriage assembly 14*b*.

As best shown in FIG. 19, each of the carriage teeth 54*b*, 54*c* further includes a peripheral side surface 57*b*, 57*c* extending from the top end 55*b*, 55*c* to the bottom end 56 and defining a peripheral profile of the carriage teeth 54*b*, 54*c*. In the illustrated example, the peripheral side surface 57*b*, 57*c* of each tooth is semi-cylindrical in shape and defines a convex peripheral profile of each tooth 54*b*, 54*c* relative to the front surface 40 of the front engagement element 39*b*. While the illustrated example provides a semi-cylindrical peripheral side surface 57, the peripheral side surface 57*b*, 57*c* may also be polygonal in shape. With reference to FIG. 20, the peripheral side surface 57*b*, 57*c* defines a length $L_{54b}$, $L_{54c}$ and width $W_{54}$ of each carriage tooth 54*b*, 54*c*. Here, the lengths $L_{54b}$, $L_{54c}$ are measured as a distance from the front surface 40 to a distal end or apex of the carriage tooth 54*b*, 54*c* (i.e., along the second direction $D_2$) while the width $W_{54}$ is measured from a first side of the carriage tooth 54*b*, 54*c* to a second side of the carriage tooth 54*b*, 54*c* (i.e., along the first direction $D_1$). Optionally, the carriage teeth 54*b*, 54*c* may be provided as primary carriage teeth 54*b* having a first length $L_{54b}$ and secondary carriage teeth 54*c* having a second length $L_{54c}$ that is less than the first length $L_{54b}$. Here, the primary carriage teeth 54*b* extend a greater distance from a front surface 40 of the front engagement element 39 than the secondary carriage teeth 54*c*. Thus, the upper surfaces defined by the top ends 55*b* of the primary carriage teeth 54*b* is larger and extends farther into the rail engagement mechanism 16 than the upper surfaces defined by the shorter top ends 55*c* of the secondary carriage teeth 54*c*.

The primary carriage teeth 54*b* and the secondary carriage teeth 54*c* cooperate to facilitate the desired balance of stability and adjustability. For instance, the longer primary carriage teeth 54*b* provide a greater interface with the upper flange 50 of the rail engagement mechanism (i.e., vertical and torsional stability) while the shorter secondary carriage teeth 54*c* provide reduced lateral resistance, allowing the carriage assembly 14*b* to be laterally translated along the rail 12 by applying the translation force F1 to the gripping members 44. While the illustrated example shows the primary carriage teeth 54*b* and the secondary carriage teeth 54*c* arranged in a repeating pattern of one secondary carriage tooth 54*c* and two primary carriage teeth 54*b* along the front surface 40 of the front engagement element 39, the front engagement element 39 may include any number or arrangement of the primary carriage teeth 54*b* and the secondary carriage teeth 54*c* to provide a desired balance of vertical stability and lateral adjustability.

Optionally, one or more of the carriage teeth 54*b*, 54*c* may further include a lower biasing surface extending from the bottom end 56. Here, the lower biasing surface 58 is formed as a substantially planar surface oriented at an oblique angle relative to the front surface 40 of the front engagement element 39, such that lengths of each of the carriage teeth 54*b*, 54*c* increase along a direction from the bottom end 56 to the top end 55. As shown, the lower biasing surfaces 58 of the primary carriage teeth 54*b* and the secondary carriage teeth 54*c* extend at the same angle. Optionally, the lower biasing surface 58 may include an arcuate or convex portion formed immediately adjacent to the bottom end 56. In use, the lower biasing surface 58 surfaces as ramp for engaging the carriage engagement mechanism 18*b* with the rail engagement mechanism 16. Specifically, as the front portion 20 of the carriage assembly 14*b* is lowered into the rail 12, the lower biasing surface 58 engages the upper flange 50 of the front wall 26 and biases the front engagement element 39 of the carriage engagement mechanism 18*b* into a retracted state (i.e., the carriage teeth 54*b*, 54*c* are retracted into the cavity 35). Once the carriage teeth 54*b*, 54*c* are fully engaged with the rail engagement mechanism 16, the biasing element 37 moves the front engagement element 39 back to the extended state so that the carriage teeth 54*b*, 54*c* are engaged below the upper flange 50. Thus, the lower biasing surfaces 58 allow the carriage assembly 14*b* to be engaged (i.e., snapped into) with the rail 12 without manually moving the carriage engagement mechanism 18*b* between the extended and retracted positions (i.e., without using a manual button or actuator).

Figure 17:
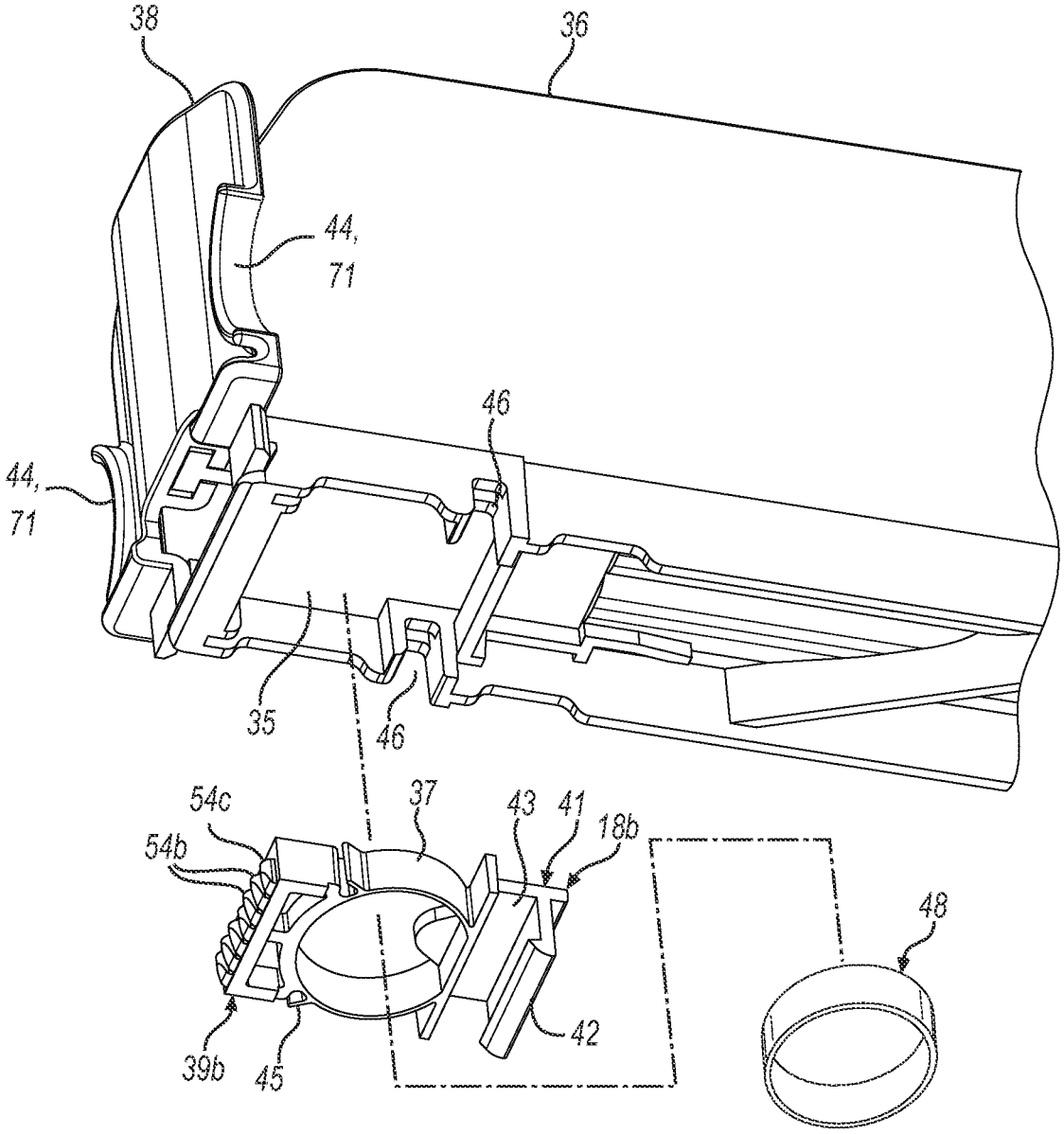
FIG. 17 is an exploded, fragmentary bottom perspective view of the product carriage assembly of FIG. 13.

Referring to FIG. 17, the carriage engagement mechanism 18*b* may be provided with one or more adjustment inserts 48 configured to interface with the biasing element 37 to modify or adjust the stiffness of the biasing element 37. For example, the rail engagement mechanism 16*b* may include removable adjustment inserts 48 having different wall thicknesses or material properties to define different levels of stiffness. In the illustrated example, the adjustment inserts 48 are embodied as insert rings 48 that can be received within the annular body of the biasing element 37. A user may replace or supplement adjustment inserts 48 as desired based on the type of product being stocked on the product management system. For example, heavier products may require a relatively stiff adjustment insert 48 to minimize inadvertent disengagement or translation of the carriage assembly 14*b*, while lighter products may require a relatively compliant adjustment insert 48 or no adjustment insert to allow the carriage assembly 14*b* to be easily adjusted.

Referring now to FIGS. 21-26, another product management assembly 10*c* including a carriage assembly 14*c* for use with a rail 12*c* and/or a pusher (not shown) is provided. In view of the substantial similarity in structure and function of the components associated with the carriage assembly 14*c* relative to the carriage assembly 14, like reference numerals are used hereinafter and in the drawings to identify like components while like reference numerals containing letter extensions are used to identify those components that have been modified.

In this example, the rail 12*c* is provided with a resilient or dynamic rail engagement mechanism 16*c* while the carriage base 34 of the carriage assembly 14*c* is provided with a stationary or static carriage engagement mechanism 18*c*. Here, the carriage engagement mechanism 18*c* may be formed as an integral part of the carriage assembly 14*c*, whereby the carriage teeth 54-54*c* are formed directly on a front surface of the divider. The carriage teeth 54-54*c* may have any of the configurations discussed above.

As best shown in FIGS. 23-26, the rail 12*c* may be described as including a frame 90, the rail engagement mechanism 16*c*, and a resilient member 92 attaching the rail engagement mechanism 16*c* to the frame 90. Here, the frame 90 is part of the front wall 26*c* of the rail 12 and includes a front sidewall 94 and the upper flange 50 extending from the front sidewall 94 to define a front channel 96. The resilient member is disposed within the front channel 96 and may include a front surface 98 that is attached to a rear surface of the front sidewall 94. The carriage engagement mechanism 16*c* may also be received within the front channel 96 and attached to a rear surface 100 of the resilient member 92. Particularly, the rail engagement mechanism 16*c* may include a front wall 102 that attaches to the rear surface 100 of the resilient member 92. The rail teeth 52 extend from a rear surface of the front wall 102 of the rail engagement mechanism 16*c*. Here, the front wall 102 of the rail engagement mechanism 16*c* is configured as a flexible member having a relatively high hardness so that the front wall 102 bends along the length of the resilient member 92 as the carriage teeth 54 are translated along the rail teeth in the first direction D1. While the illustrated example shows the rail teeth 52 as extending from the front wall 102 of the rail engagement mechanism 16*c*, in other examples the rail teeth 52 may directly incorporate the resilient material without the use of a resilient member or may be directly coupled to the resilient member 92. Furthermore, the resilient member 92 may be provided as a unitary element coupled to a plurality of the rail teeth 52, or may include a plurality of independent resilient members 92 each coupled to one or more of the rail teeth 52.

Optionally, the rail engagement mechanism 16*c* may define an upper flange 104 and/or an opposite lower flange 106. Here, the upper flange 104 provides an upper engagement interface for the top ends 55*b*, 55*c* of the carriage teeth 56*b*, 56*c*. One or both of the upper flange 104 and the lower flange 106 may be omitted from the rail engagement mechanism 16*c*, such that the frame 90 of the rail 12*c* defines the upper and lower surfaces of the rail engagement mechanism 16*c*.

In the illustrated example, the resilient member 92 includes one or more strips of a resilient polymeric material having a lower durometer and greater resilience than the materials of the frame 90 and the rail engagement mechanism 16*c*. For example, foamed polymers and rubbers are suitable materials. Additionally or alternatively, the resilient member 92 may include a compressible mechanical structure, such as a helical compression spring or a leaf spring disposed between the front sidewall 94 of the frame 90 and the front wall 102 of the rail engagement mechanism 16*c*.

The resilient member 92 is configured to provide a biasing force F3 in the second direction to counteract a compressive force F4 applied to the rail engagement mechanism 16*c* by the carriage teeth 54*b*, 54*c* when the carriage assembly 14*c* is translated along the first direction $D_1$. For example, when a lateral force is applied to the carriage assembly 14*c* in the first direction $D_1$, the convex carriage teeth 54*b*, 54*c* may apply a compressive force to the distal ends of the rail teeth 52 to bias the rail teeth 52 in the second direction $D_2$ towards the front sidewall 94 of the frame 90. Once a desired lateral position is obtained and the carriage teeth 54*b*, 54*c* are engaged (i.e., received between) the rail teeth 52, the resilient member 92 biases the rail engagement mechanism 16*c* in the second direction $D_2$ so that the second rail teeth 52 extend between adjacent ones of the carriage teeth 54. The resilient member 92 and the rail engagement mechanism 16*c* may be configured so that only a localized portion of the rail engagement mechanism 16*c* flexes as the carriage assembly 14*c* is translated. In other words, the rail engagement mechanism 16*c* may deform or flex in a wave-like manner as the carriage teeth 54*b*, 54*c* depress a corresponding portion of the rail engagement mechanism 16*c*.

The aforementioned examples of carriage assemblies 14-14*c* are configured to provide for an easily adjustable and durable product management system 10, whereby lateral positions of the carriage assemblies 14-14*c* can be changed by a user without the use of an actuator for manually engaging and disengaging the rail 12. Instead, the configurations and materials of the rail teeth 52 and/or the carriage teeth 54-54*c* are designed and selected to allow one or both sets of teeth 52, 54-54*c* to move or flex relative to the other set of teeth 52, 54-54*c* in the second direction $D_2$ in response to application of a force in the lateral direction $D_1$. In other words, a lateral force F1 applied to the carriage is translated to a longitudinal force that causes one of the sets of teeth 52, 54-54*c* to move in the second direction $D_2$ away from the other set of teeth 52, 54-54*c*, thereby allowing the carriage teeth 54-54*c* to pass along the rail teeth 52 in the first direction $D_1$.

While the carriage assemblies 14-14*c* of the present disclosure are embodied as product dividers including the dividing wall 36 attached to the carriage base 34-34*c*, the principles of the present disclosure may be applied to carriage assemblies configured for other uses in a product management system. For example, the carriage assemblies 14-14*c* may be configured to include a dynamic product pusher that is configured to bias a product inventory towards the front portion of the carriage assembly 14-14*c*, as is known in the art. Such a configuration may be realized by forming a track in or along the top surface of the carriage base 34-34*c*. Other implementations of the carriage base 34-34*c* may also be realized without departing from the principles of this disclosure.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A retail management system comprising:

a carriage base including a first end defining a front surface and a second end formed at an opposite end from the first end; and an engagement mechanism disposed at the first end of the carriage base and including a plurality of carriage teeth extending from the front surface, the plurality of carriage teeth including at least one primary carriage tooth having a first configuration and a secondary carriage tooth having a second configuration that is different than the first configuration, each carriage tooth of the plurality of carriage teeth including a top end, a bottom end, and peripheral side surfaces defining a semi-cylindrical convex peripheral profile extending from the top end to the bottom end.

2. The system of claim 1, wherein the first configuration includes a first length measured from the front surface to a distal end of the primary carriage tooth and the second configuration includes a second length measured from the front surface to a distal end of the secondary carriage tooth.

3. The system of claim 1, wherein the top end of each of the carriage teeth defines a substantially planar surface perpendicular to the front surface.

4. The system of claim 1, wherein each of the carriage teeth has a first height extending along the front surface from the bottom end to the top end and includes a lower biasing surface formed adjacent to the bottom end.

5. The system of claim 4, wherein the lower biasing surface extends at an oblique angle relative to the front surface of the carriage base.

6. The system of claim 4, wherein the lower biasing surface includes an arcuate portion immediately adjacent to the bottom end.

7. The system of claim 4, wherein the lower biasing surface has a second height that is at least half of the first height.

8. The system of claim 4, wherein each of the carriage teeth includes an arcuate peripheral side surface extending between the bottom end and the top end.

9. The system of claim 1, wherein the engagement mechanism is operable between a retracted position and an extended position relative to the front surface of the carriage base.

10. The system of claim 1, wherein the engagement mechanism is integrally formed with the front surface of the carriage base.

11. The system of claim 10, wherein the engagement mechanism is a carriage engagement mechanism, and wherein the system further comprises:

a rail including a rail engagement mechanism operable to move between a first configuration and a second configuration.

12. The system of claim 11, wherein the rail includes a frame and the rail engagement mechanism is attached to the frame and operable to move a first configuration and the second configuration.

13. The system of claim 12, wherein the rail engagement mechanism includes a plurality of rail teeth configured to move relative to the frame.

14. The system of claim 13, wherein each of the plurality of the rail teeth is coupled to the frame by a resilient member including a different material than the frame.

15. The system of claim 14, wherein each of the plurality of the rail teeth is integrally formed with the resilient member.

16. The system of claim 15, wherein the rail engagement mechanism includes a flexible front wall attached to the resilient member and the plurality of the rail teeth extend from the front wall.

17. The system of claim 14, wherein the resilient member includes a strip of a first material disposed between the frame and the rail engagement mechanism, the first material having a lower durometer than a second material forming the frame or the rail engagement mechanism.

* * * * *